US012377319B2

(12) United States Patent
Browning et al.

(10) Patent No.: US 12,377,319 B2
(45) Date of Patent: Aug. 5, 2025

(54) FLOATABLE BREATHING DEVICE

(71) Applicant: Blue Spring Partners, LLC, Idaho Falls, ID (US)

(72) Inventors: Steve Browning, Idaho Falls, ID (US); J. Rodney Garber, Mount Joy, PA (US)

(73) Assignee: RTB Innovations LLC, Mount Joy, PA (US)

( * ) Notice: Subject to any disclaimer, the term of this patent is extended or adjusted under 35 U.S.C. 154(b) by 1062 days.

(21) Appl. No.: 17/371,756

(22) Filed: Jul. 9, 2021

(65) Prior Publication Data

US 2021/0331039 A1 Oct. 28, 2021

Related U.S. Application Data

(63) Continuation-in-part of application No. 17/115,900, filed on Dec. 9, 2020, now Pat. No. 11,794,076, (Continued)

(51) Int. Cl.
*A63B 33/00* (2006.01)
*A41D 7/00* (2006.01)
(Continued)

(52) U.S. Cl.
CPC ..... *A63B 33/002* (2013.01); *A41D 7/00* (2013.01); *B63C 11/16* (2013.01);
(Continued)

(58) Field of Classification Search
CPC ... A63B 33/00; A63B 33/002; A63B 2208/03; A63B 2244/20–203; A41D 7/00–003;
(Continued)

(56) References Cited

U.S. PATENT DOCUMENTS 5,697,362 A * 12/1997 Albrecht ..... B63C 11/205 128/201.27
2010/0229858 A1* 9/2010 Wheelwright ..... B63C 11/205 2/426

FOREIGN PATENT DOCUMENTS

FR 573287 A * 6/1924 ..... B63C 11/207

* cited by examiner

*Primary Examiner* — Elliot S Ruddie
(74) *Attorney, Agent, or Firm* — Barley Snyder

(57) ABSTRACT

The present invention relates to a floatable breathing device. The floatable breathing device provides includes a head unit, a snorkel, a plurality of receiving passageways, and an internal pathway. The head unit has buoyant properties and includes an ornamental shaped buoyant outer material and an inner shell positioned within the buoyant outer material. The inner shell forms a head receiving section and a protruding section. The head receiving section is received internal to the buoyant outer material and is configured to be contoured to a human head, the protruding section extending from the head receiving section to a vent opening in the outer buoyant material. The snorkel is connected to and extending through the head unit, while the plurality of receiving passageways are disposed about the inner shell and receiving the snorkel such that the snorkel extends through and exits a portion of the head unit at the vent opening. The internal pathway is positioned along a base of the outer buoyant material and extends between the internal shell and the buoyant outer material, passing to the interior of the interior shell through a cutout in a protruding portion thereof and terminating adjacent to the vent opening.

14 Claims, 19 Drawing Sheets

Related U.S. Application Data which is a continuation of application No. 16/160,251, filed on Oct. 15, 2018, now Pat. No. 10,898,761.

(51) Int. Cl.
*B63C 11/12* (2006.01)
*B63C 11/16* (2006.01)

(52) U.S. Cl.
CPC ..... *A63B 2208/03* (2013.01); *A63B 2244/20* (2013.01); *B63C 2011/128* (2013.01)

(58) Field of Classification Search
CPC ... B63C 11/16; B63C 2011/165; B63C 11/18; B63C 11/20–22; B63C 2011/128
USPC ..... 128/201.11
See application file for complete search history.

FLOATABLE BREATHING DEVICE

CROSS-REFERENCE TO RELATED APPLICATIONS

This application is a continuation in part of U.S. patent application Ser. No. 17/115,900, filed on Dec. 9, 2020, which is a continuation of U.S. patent application Ser. No. 16/160,251, filed on Oct. 15, 2018, now U.S. Pat. No. 10,898,761.

FIELD OF THE INVENTION

The invention is related to a floatable breathing device, and more particularly a floating breathing device having a floating ornamental head unit.

BACKGROUND

People commonly use snorkels to dive and view under water scenery. An inherent problem with the common snorkel is that for younger users they are likely to swallow water or to drop their snorkel tube below the water line thereby causing difficulty in breathing. In the current field of the invention, the user is left with the choice of only using a diving mask or goggles and surface swimming and not experiencing the under surface environment or waiting until younger divers are older more experienced and stronger swimmers who are better able to keep their tubes vertical and devoid of water. The state of the art needs a solution that permits younger divers to enjoy the benefit of being able to snorkel with their older family members without the detrimental consequences of the current state of the art. The state of the art needs a floatable breathing device.

SUMMARY

In light of the shortcoming above a floatable breathing device according to the invention is provided. The present invention relates to a floatable breathing device. The floatable breathing device provides includes a head unit, a snorkel, a plurality of receiving passageways, and an internal pathway. The head unit has buoyant properties and includes an ornamental shaped buoyant outer material and an inner shell positioned within the buoyant outer material. The inner shell forms a head receiving section and a protruding section. The head receiving section is received internal to the buoyant outer material and is configured to be contoured to a human head, the protruding section extending from the head receiving section to a vent opening in the outer buoyant material. The snorkel is connected to and extending through the head unit, while the plurality of receiving passageways are disposed about the inner shell and receiving the snorkel such that the snorkel extends through and exits a portion of the head unit at the vent opening. The internal pathway is positioned along a base of the outer buoyant material and extends between the internal shell and the buoyant outer material, passing to the interior of the interior shell through a cutout in a protruding portion thereof and terminating adjacent to the vent opening.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
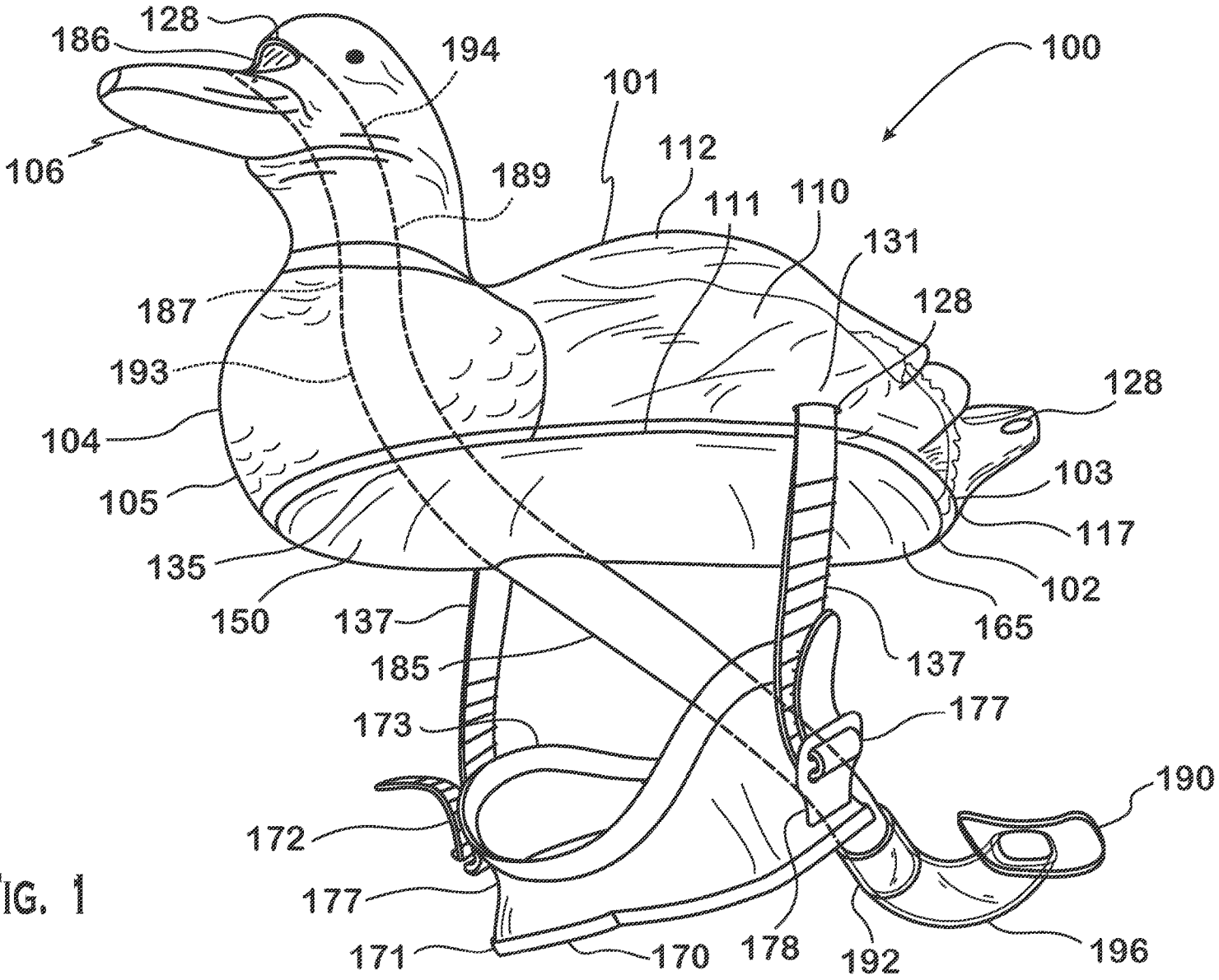
FIG. 1 is a perspective view of a floatable breathing device according to the invention.
Figure 2:
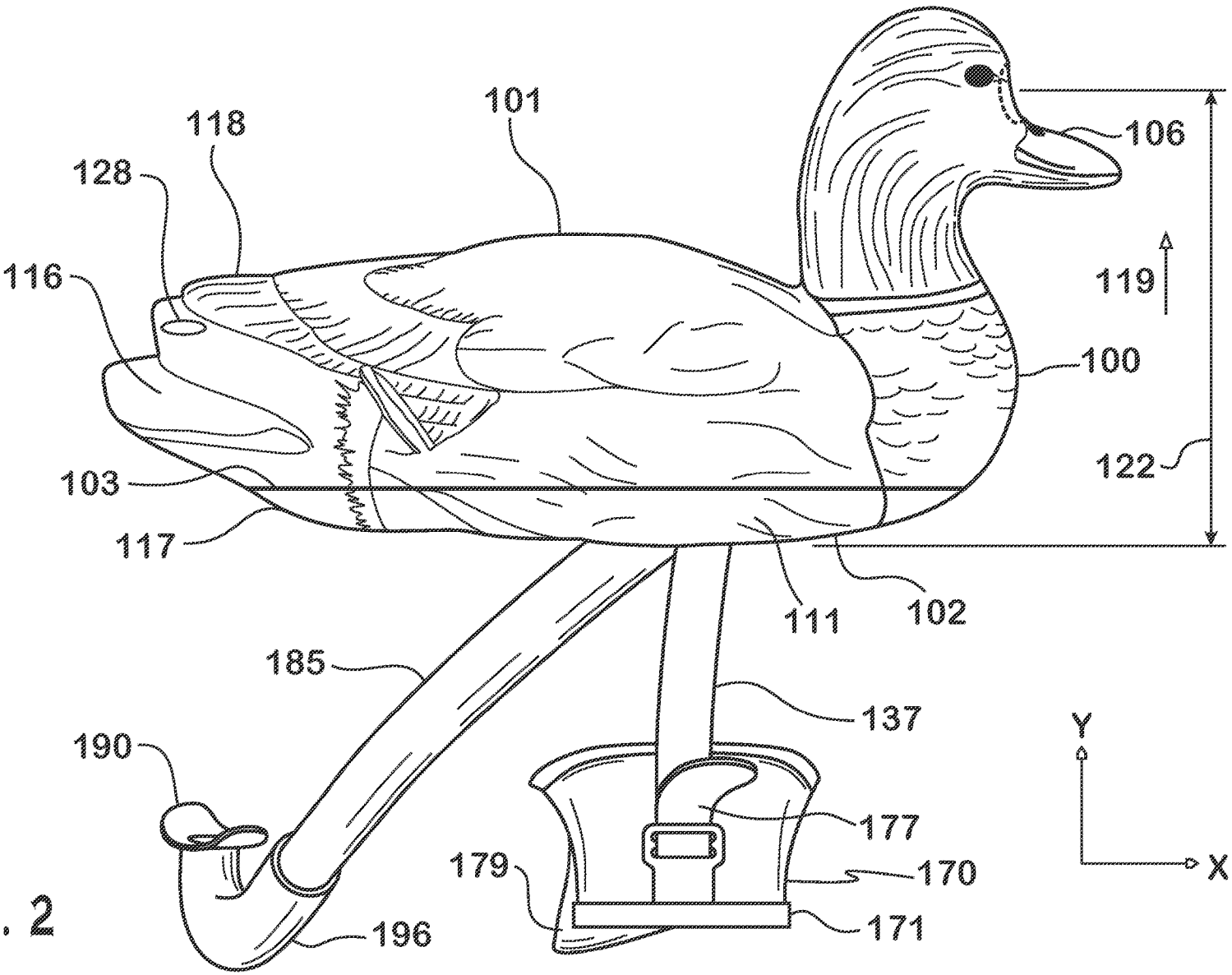
FIG. 2 is a side perspective view of a floatable breathing device of FIG. 1.

Exemplary embodiments of the present invention will be described hereinafter in detail with reference to the attached drawings, wherein like reference numerals refer to like elements.

The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

Now with reference to the figures a floatable breathing device 1 according to the invention will be described. An exemplary embodiment of the invention is shown in FIG. 1, and generally includes the following major components: a head unit 100, a mask 170 and a snorkel 185.

In FIGS. 1 through 4, the head unit 100 is configured to be interchangeable and can have a variety of different ornamental shapes. The head unit 100 generally includes an outer housing 101 and a buoyant insulated housing 165.

In the shown embodiment, the outer housing 101 is a rigid exterior shell that may be formed from one or more of a materials 139, including a foam, a polymer, a composite, a water resistant fabric, or an inflatable device. The outer housing 101 may be impact resistant and may be made of buoyant material and may be monolithically formed.

The outer housing 101 is shaped to have a front portion 104, a center portion 110, and a rear portion 116. The front portion 104 has a lower front portion 105, adjacent a base 102 of the outer housing 101 and an upper front portion 106 that extends up from the lower front portion 105 of the outer housing 101. The center portion 110 has a lower center portion 111 adjacent the base 102 and an upper center portion 112 positioned up away from the base 102. A waterline 103 is also provided and extends along a periphery of the lower portions 105, 111, and 117 above the base 102. The waterline 103 is dependent on the buoyancy of the head unit 100.

Further, a plurality of receiving passageways 128 may be formed along an exterior surface 131 of the outer housing 101 to receive portions of the snorkel 185, the mask 170, or an accessory, e.g., a light, a flag, a locator beacon or any other accessory known to one of ordinary skill in the art (not shown). The receiving passageways 128 are positioned along the outer housing 101 or along an upper rear portion 118 of the outer housing 101 for the attachment of accessories e.g., a light, a flag, a locator beacon or any other accessory known to one of ordinary skill in the art. Opposite the exterior surface 131 is an interior surface 124. The interior surface 124 encompasses the inside surface of the outer housing 101.

As shown, the head unit 100 has the upper front portion 106, extending away from the base 102 in a vertical direction 119 distancing the base 102 away from the upper front portion 106 a sufficient distance 122 from the base 102 of the outer housing 101 to ensure the upper front portion 106 is relatively free of water. Further, extending along a length of the base 102 is the waterline 103 indicating the level at which water should be when the outer housing 101 is located in a body of water. A lower rear portion 117 is positioned along the base 102 and proximate to the waterline 103. Positioned on the rear portion 116 is the receiving passageway 128 adjacent to the upper rear portion 118.

In the shown embodiment, the outer housing 101 is shaped into the design of an animal, such as a bird, a fish, or a mammal. In particular, FIG. 1 illustrates the outer housing 101 formed as a duck. However, one skilled in the art should appreciate that other design are possible.

Figure 3:
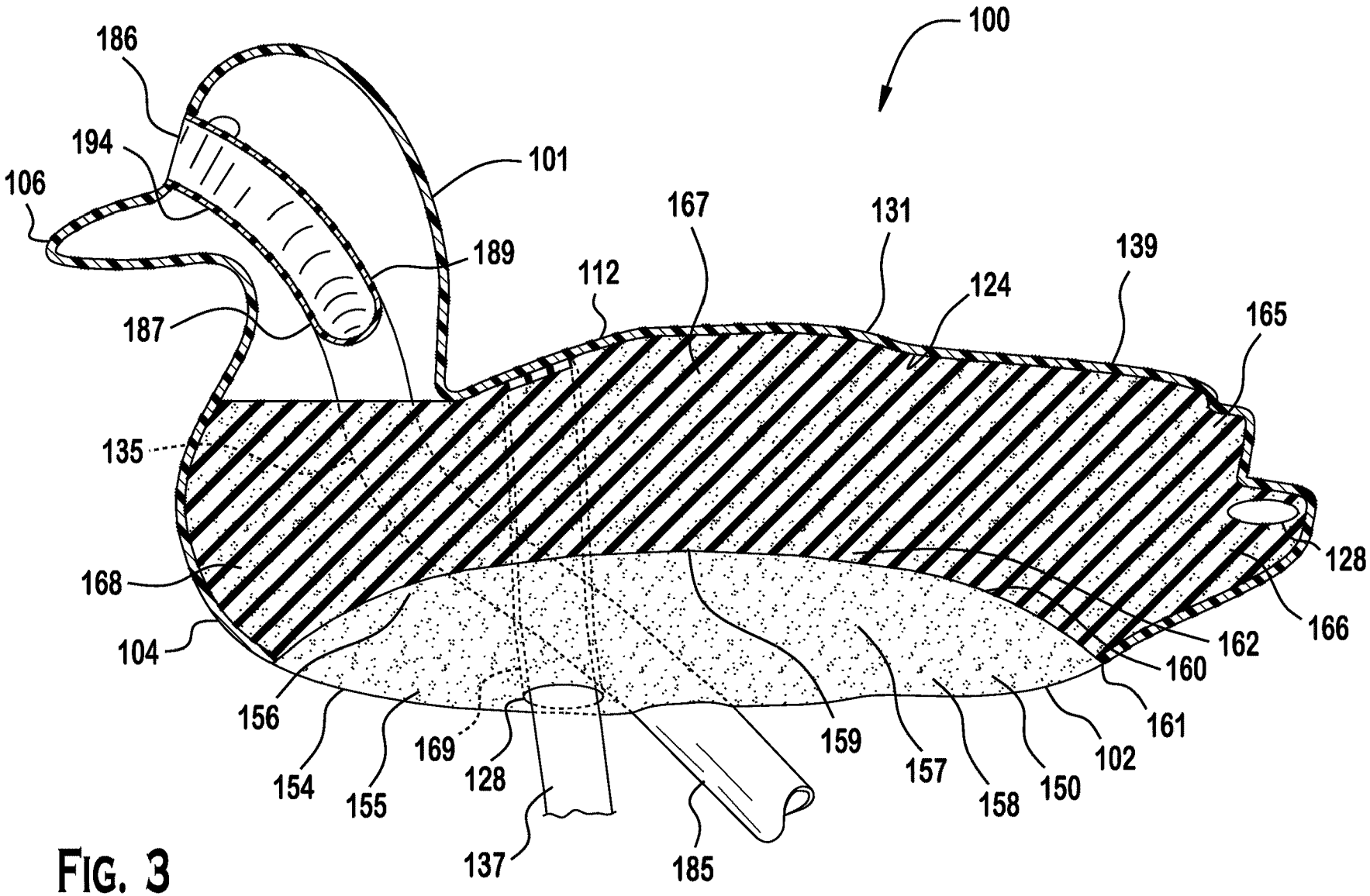
FIG. 3 is a sectional side view of the floatable breathing device of FIG. 1.

As shown in FIG. 3, the insulated housing 165 is positioned in the outer housing 101. More particularly, the insulated housing 165 is a moldable material formed in the outer housing 101 and may be a light density material such as foam or an inflatable device that includes a bladder and may be filled with a gas or be fashioned in any other way as known in the art to add buoyancy to the head unit 100. Additionally, in certain embodiments, the insulated housing 165 may be especially adapted to colder environments and have additional features to prevent heat loss by a user.

Generally, the insulated housing 165 has a rearmost insulated housing 166, a central insulated housing 167 and a front most insulated housing 168. The insulated housing 165 extends from the rearmost insulated housing 166, through the central insulated housing 167 and the front most insulated housing 168.

Formed within the insulated housing 165 is a passageway 169. The passageway 169 is formed along a portion of the central insulated housing 167 of the insulated housing 165 for receiving a strap 137. The passageway 169 extends through the side of the central insulated housing 167, up through a portion of the front most insulated housing 168 of the insulated housing 165, and a side of the center portion 110 of the outer housing 101.

A head receiving section 150 is positioned internal to the outer housing 101. More particularly, the head receiving section 150 is formed by the insulated housing 165 positioned in the outer housing 101.

As shown in FIG. 3, the head receiving section 150 has a rear section 160, a lower rear section 161, an upper rear section 162, a center section 157, a lower center section 158, an upper center section 159, a front section 154 including a lower front section 155 and an upper front section 156. The lower front section 155 of the head receiving section 150 starts along a lower edge of the front portion 104 of the outer housing 101. The head receiving section 150 is adjustable and contoured to receive a plurality of head shapes.

In the exemplary embodiment shown, the head unit 100 further includes an internal pathway 135 formed in the center section 157 of the head receiving section 150 beginning along the base 102 of the outer housing 101 continuing through the head receiving section 150 extending up from the lower center section 158 away from the base 102 through the upper center section 159 and through the upper front section 156 of the head receiving section 150 and continuing through the exterior surface 131 of the housing in the upper front portion 106.

Figure 4:
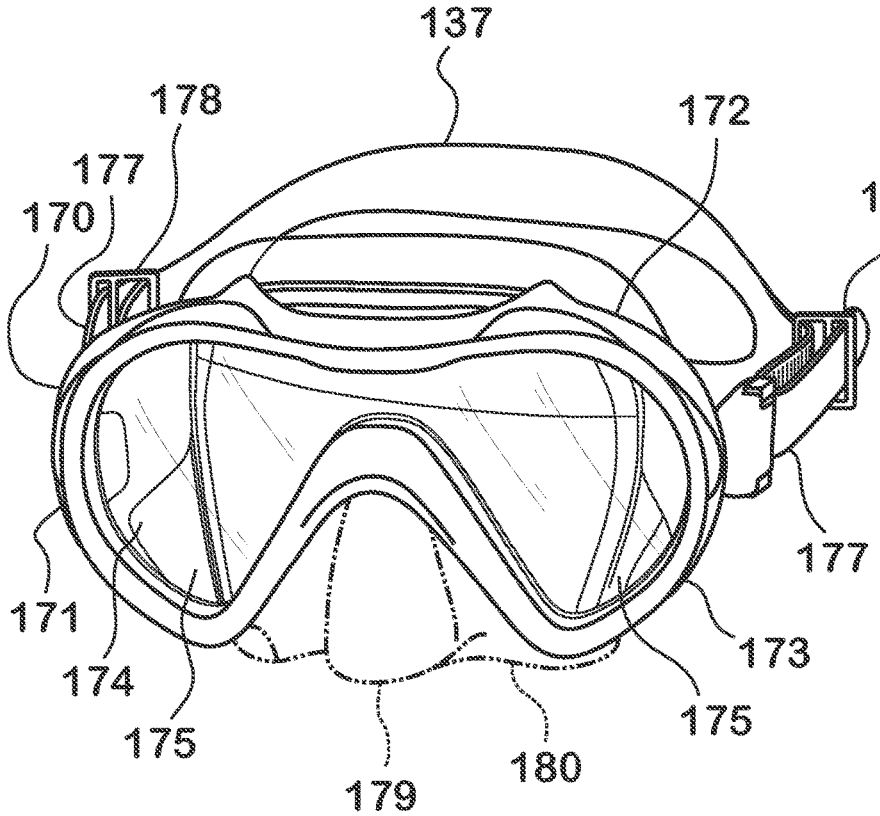
FIG. 4 is a perspective view of a mask according to the invention.

As shown in FIG. 4, the mask 170 includes a frame 171 positioned there about and a pliable skirt 172 positioned around a periphery 173 of the frame 171. A plurality of strap buckles 178 are provided and positioned along a plurality of lateral sides 177 of the mask 170.

As further shown in FIG. 4, the mask 170 has the strap 137 extending from one of the strap buckles 178 positioned on the lateral side 177 back around to another of the strap buckles 178 positioned on the lateral side 177 opposite the first. The frame 171 forms a lens socket 175 for receiving a lens 174. Along the periphery 173 of the frame 171 is the pliable skirt 172. Positioned between the lens 174 is a nose pocket 179 forming a nose seal 180 against a user. One of ordinary skill in the art would understand in some embodiments the mask 170 will have no nose pocket 179.

Figure 5:
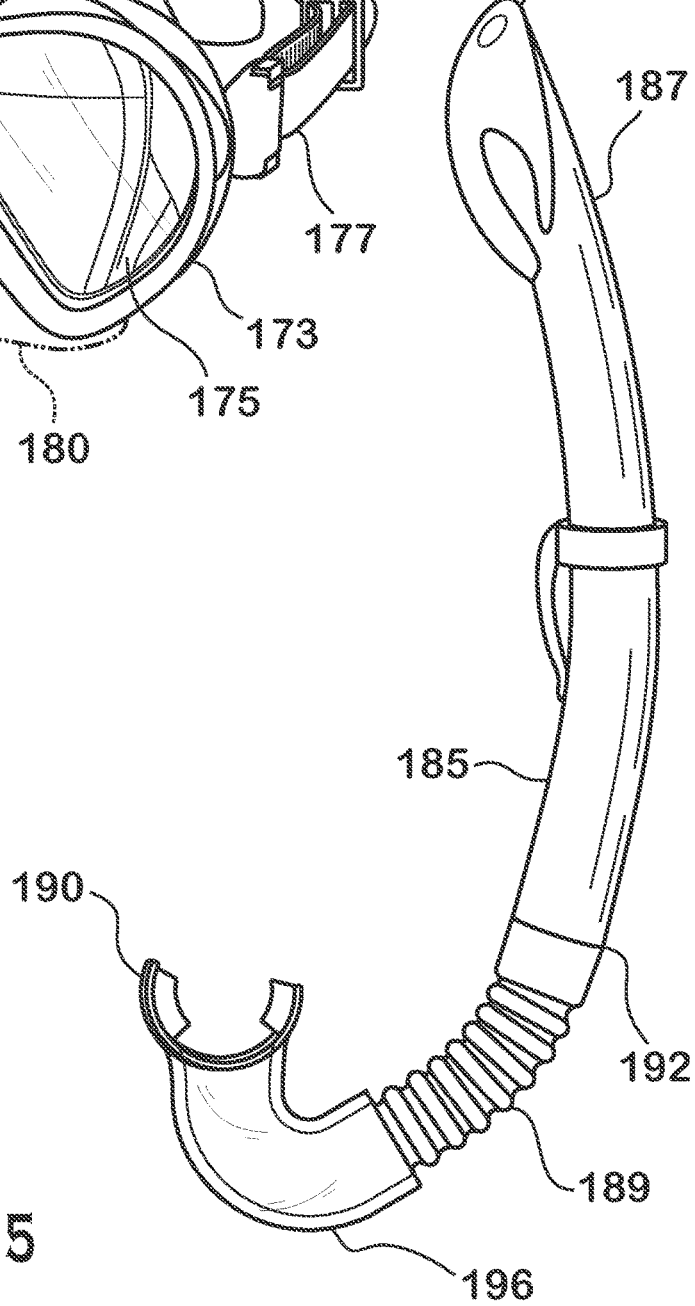
FIG. 5 is a perspective view of a snorkel according to the invention.

As shown in FIG. 5, the snorkel 185 includes an end piece 186 positioned at a proximal end thereof and a mouthpiece 190 positioned at a distal end thereof. The snorkel 185 further includes a barrel section 187 positioned below an uppermost end 194 and made of a material that includes one or more of a bendable sections 189. The snorkel 185 further includes a u-shaped section 196 positioned between the barrel section 187 and the mouthpiece 190. The snorkel 185 has a sealed section 192 along the length between the mouthpiece 190 and the end piece 186. The snorkel 185 is adaptable to different users and has a plurality of lengths 193. Further, the head units 100 may have a variety of ornamental shapes.

In the embodiment shown, the mask 170 is positioned beneath the head receiving section 150.

As shown in FIG. 5, the mouthpiece 190 is positioned at a lower portion and the u-shaped section 196 is positioned adjacent to the mouthpiece 190. The bendable section 189 can be positioned in a single position or can in some embodiments be along the length of the snorkel 185. As shown the sealed section 192 is positioned at a joint of the bendable section 189 and the barrel section 187. In other embodiments, the barrel section 187 may be entirely formed of the bendable section 189 such as when corrugated tubing or smooth flexible tubing is the barrel section 187.

Now with reference back to FIGS. 1 through 3, assembly of the head unit 100 will be described.

The outer housing 101 is positioned over the insulated housing 165 forming the head receiving section 150. Along the exterior surface 131 are the plurality of receiving passageways 128. The mask 170 with the strap 137 is secured to the mask 170 by one of the strap buckles 178 on a lateral side 177 and positioned beneath the outer housing 101. The strap 137 extends up from the mask 170 and passes through one of the receiving passageway 128 and then into the side of the central insulated housing 167, up through a portion of the front most insulated housing 168 of the insulated housing 165, and a side of the center portion 110 of the outer housing 101. The strap 137 then exists the passageway 169 through the opposing receiving passageway 128 and is connected to the mask 170 on the opposite lateral side 177 by the opposing strap buckle 178. The passageway 169 extends through the side of the central insulated housing 167, up through a portion of the front most insulated housing 168 of the insulated housing 165, and a side of the center portion 110 of the outer housing 101.

The snorkel 185 is positioned beneath the mask 170 and located within the strap 137. The mouthpiece 190 is distal the end piece 186. The barrel section 187 enters the internal pathway 135 formed in the center section 157 of the head receiving section 150 beginning along the base 102 of the outer housing 101 continuing through the head receiving section 150 extending up from the lower center section 158 away from the base 102 through the upper center section 159 and through the upper front section 156 of the head receiving section 150 and continuing through the exterior surface 131 of the outer housing 101 in the upper front portion 106. The end piece 186 exits the outer housing 101 and can be positioned in different positions at the uppermost end 194 depending upon the embodiment.

Figure 6:
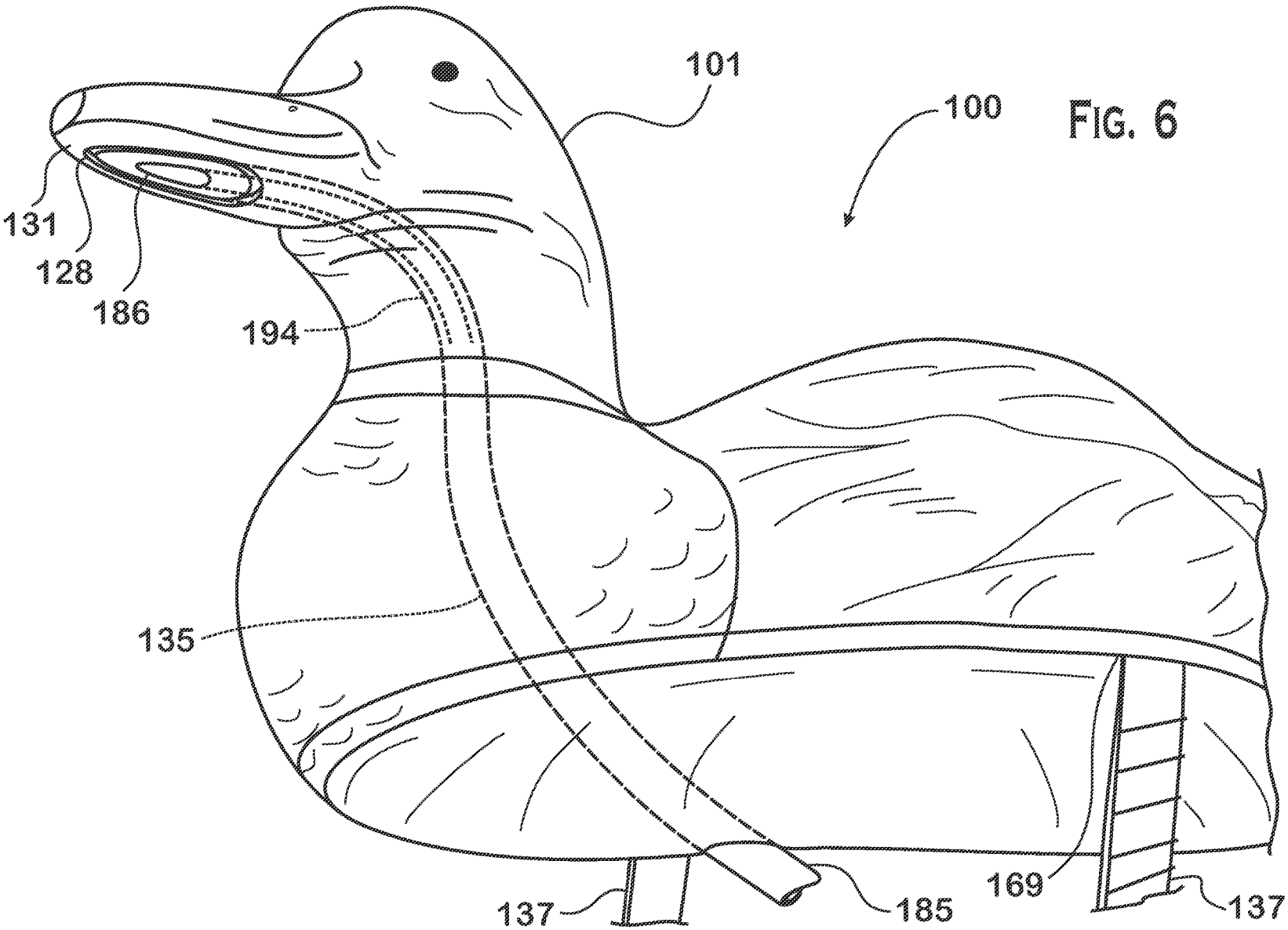
FIG. 6 is a perspective view of a head unit of another floatable breathing device according to the invention.

Now with reference to FIG. 6, an alternate embodiment of the head unit 100 will be described. For sake of brevity, only those elements that differ from the aforementioned embodiment will be described. The receiving passageway 128 is on the exterior surface 131 for the exit of the internal pathway 135. As illustrated, the snorkel 185 exits hidden under the outer housing 101 shielding the snorkel 185 from exposure to water entry.

Here the snorkel 185 passes through the internal pathway 135 and exits the outer housing 101 along the end piece 186 at the uppermost end 194. The passageway 169 for the strap 137 is hidden and passes internal to the outer housing 101 without the aid of external openings on the surface of the outer housing 101.

Figure 7:
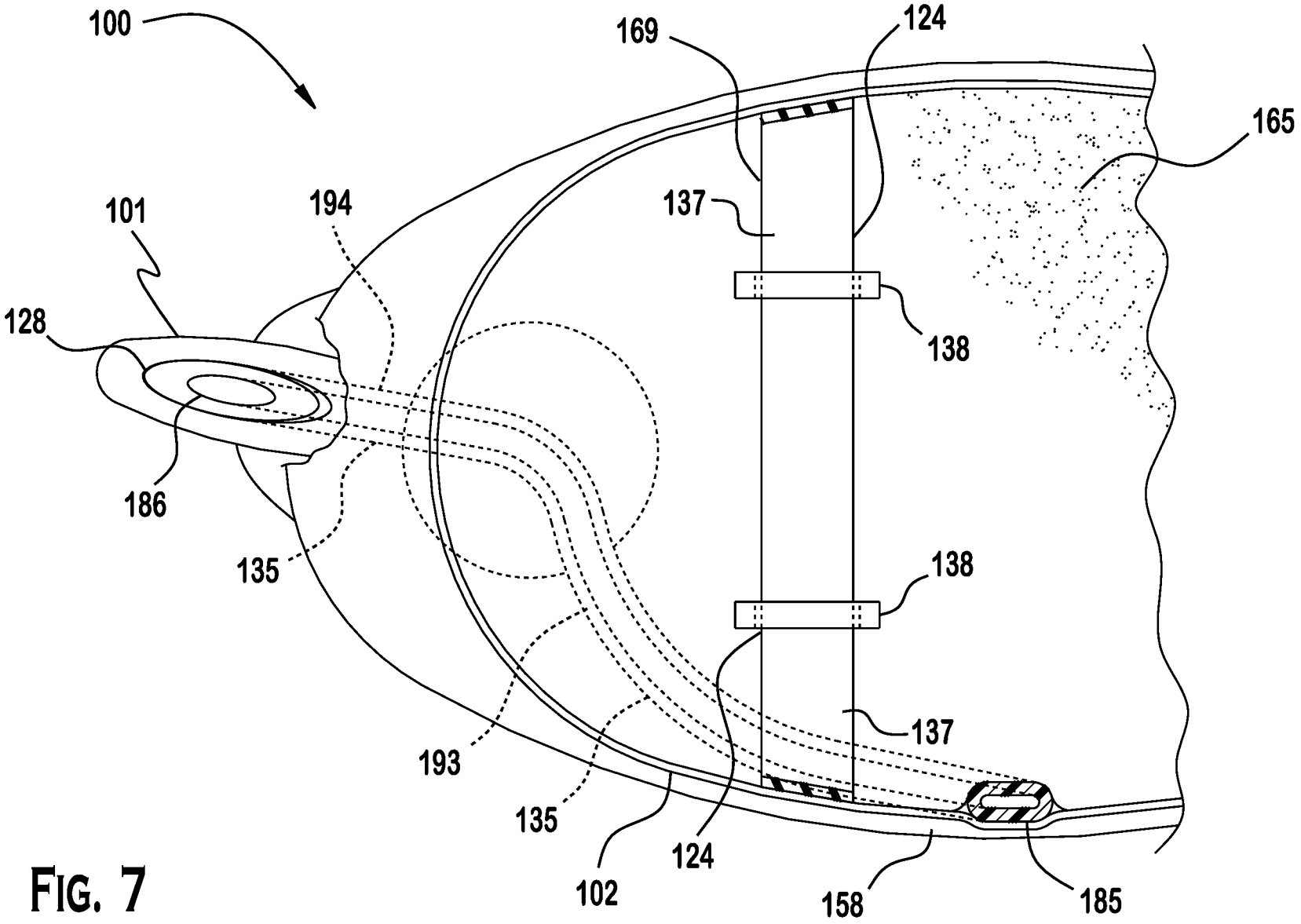
FIG. 7 is a bottom view of the head unit of FIG. 6.

As further shown FIG. 7, the snorkel 185 extends through the internal pathway 135 inside the insulated housing 165 and exits at the end piece 186 at the receiving passageway 128. It should be appreciated by one of ordinary skill in the art that the snorkel 185 may be formed of a material capable of being bent forming the bendable section 189 e.g., corrugated pipe or any other tubing having a flexible property. Likewise, the snorkel 185 is configurable to have the plurality of lengths 193. The end piece 186 is positioned at the uppermost end 194 of the snorkel 185 along the outer housing 101. The end piece 186 may in some embodiments be open in others it may contain an air valve or splash guard and in others it may also have a means of generating e.g., animal sounds or non-animal sounds during respiration of a user through the snorkel 185.

As shown in FIG. 7, the insulated housing 165, the base 102 and the snorkel 185 are viewed from below. The snorkel 185 is attached to the lower center section 158. The strap 137 is secured along the interior surface 124 of the outer housing 101 by a plurality of fasteners 138 along the center section 157 within the insulated housing 165. Additionally, the snorkel 185 passes directly through the lower front portion 105 and is secured along the interior surface 124. As shown the snorkel 185 is formed of a transparent non-corrugated material. One of ordinary skill in the art would understand that other suitable materials can be used for the snorkel 185.

Figure 10:
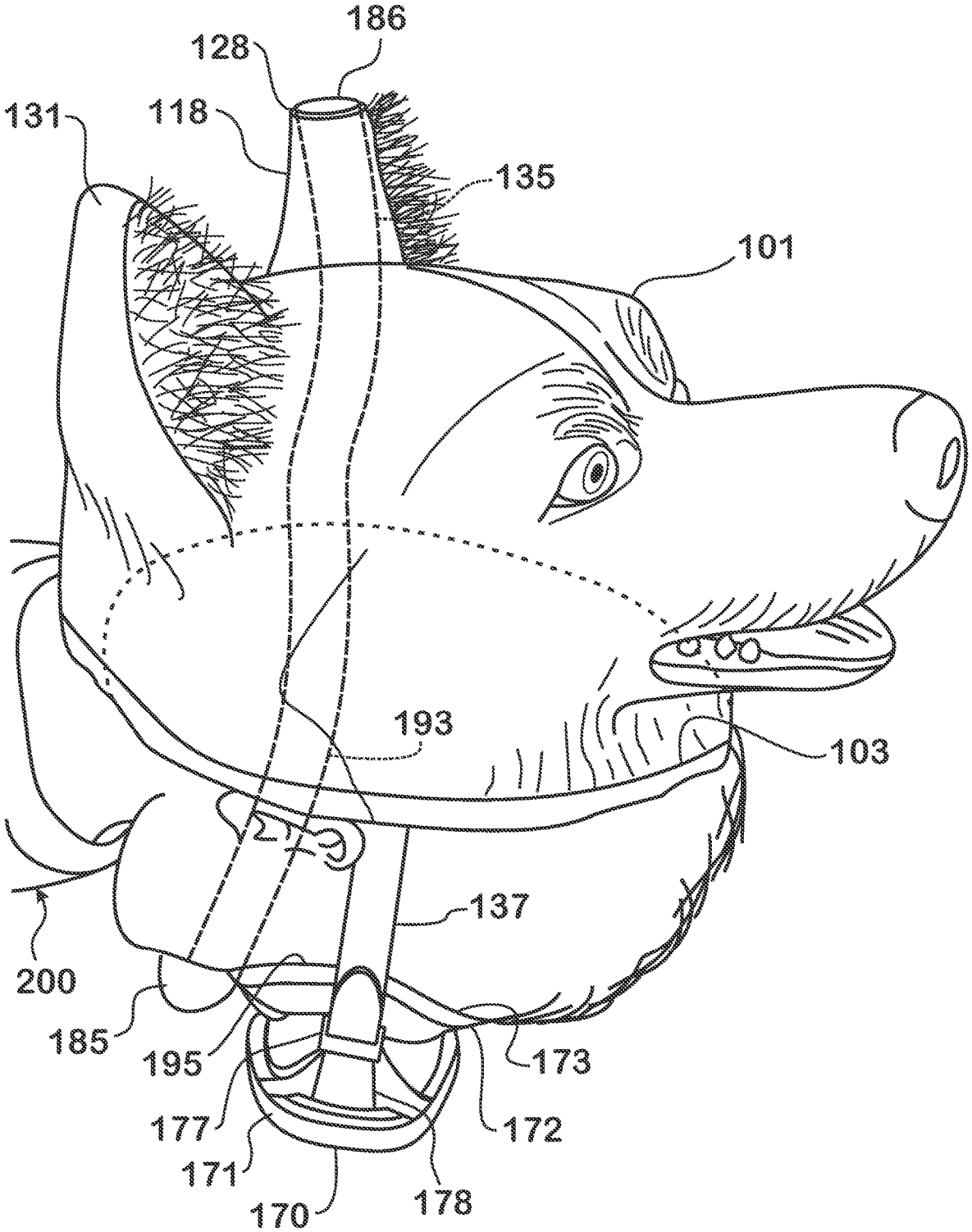
FIG. 10 is a perspective view of floatable breathing device according to the invention.

FIG. 10 shows an example alternate embodiment in a mounted state. The outer housing 101 has a different ornamental shape, namely that of a dog. The location of the receiving passageways 128 on the exterior surface 131 for the exit of the internal pathway 135 is along the upper rear portion 118 of the outer housing 101. The strap 137 is secured along the upper center portion 112 of the interior surface 124 of the outer housing 101.

Figure 8:
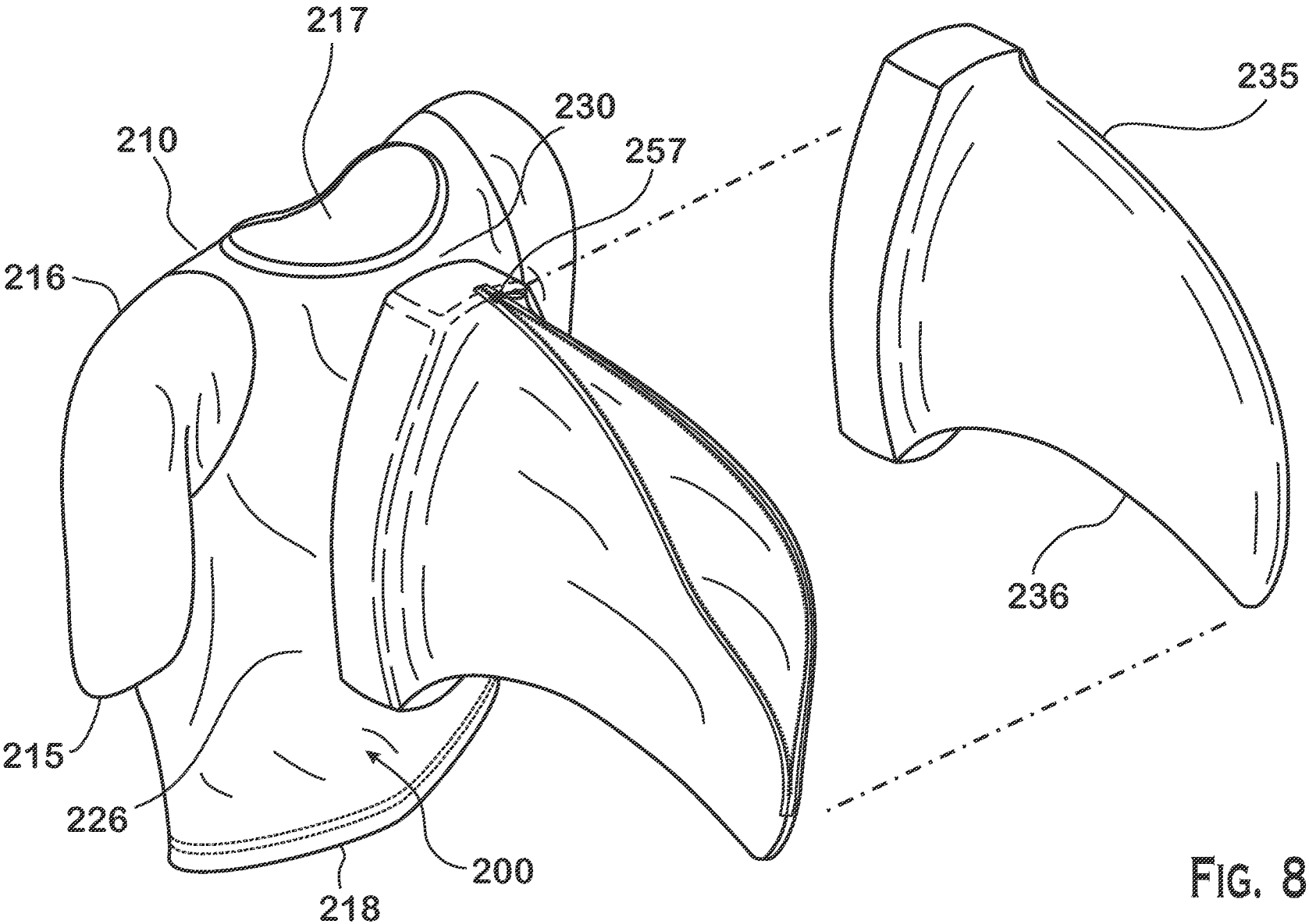
FIG. 8 is a perspective view of an integrated swim shirt assembly according to the invention.

Now with reference to FIG. 8, an integrated swim shirt assembly 200 is shown and may be used with the head unit 100 according the invention. The swim shirt assembly 200 has a swim shirt 210 and an insert receiver 230 positioned along a rear section 226 of the swim shirt 210. Around a periphery 216 of the swim shirt 210 are a plurality of arm receiving sections 215, a torso receiving section 218 and a neck receiving section 217. A changeable insert peripheral 235 can be in a variety of shapes e.g., a shark fin, a duck head, an elephant, a boat or any number of ornamental shapes and designs. The insert receiver 230 conforms to the shape of the changeable insert peripheral 235 and has an insert fastener 257 positioned along the insert receiver 230 so that the changeable insert peripheral 235 can be secured within the insert receiver 230. One of ordinary skill in the art would understand the changeable insert peripheral 235 may have a variety of ornamental shapes such as a fin 236, a shell, a plurality of alligator arms, a tail or a variety of other ornamental shapes. The changeable insert peripheral 235 may coordinate or correspond with ornamentation of the shaped head unit 100 or it may be a different ornamental shape depending upon the user's choice.

In some embodiments, the changeable insert peripheral 235 may aid in flotation by providing increased buoyancy. The integrated swim shirt assembly 200 may have properties such as UV protection and or provide a user protection from chaffing such as a rash guard. One of ordinary skill in the art would understand that the swim shirt 210 may have a variety of elements and be constructed of a plurality of materials, lengths of sleeves and sizes.

Figure 9:
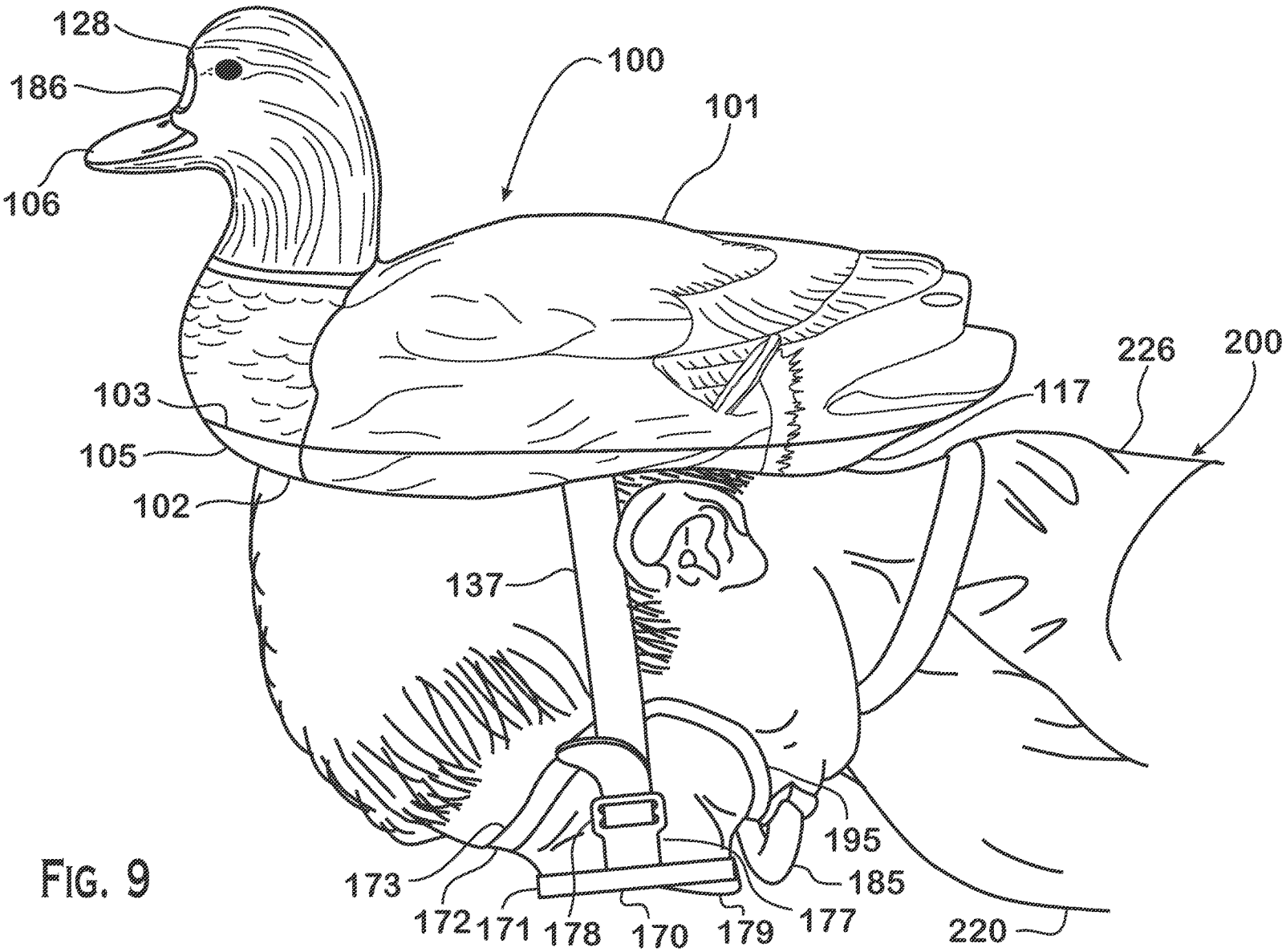
FIG. 9 is a side view of a floatable breathing device according to the invention.

Now with FIG. 9, a side view of a mounted state of the head unit 100 and the integrated swim shirt assembly 200 are shown. The base 102 of the outer housing 101 extends from the lower rear portion 117 of the user to the lower front portion 105 of the user. The integrated swim shirt assembly 200 is positioned on the user. The swim shirt 210 is coordinated in some embodiments to correspond to the outer housing 101. One of ordinary skill in the art would understand that along a front section 220 or the rear section 226 of the swim shirt 210 can be positioned flotation aids, other ornamental shapes e.g., flippers, fins, arms, legs, or any other element which may aid in swimming, flotation, or coordinating with the head unit 100 or the integrated swim shirt assembly 200.

The mask 170 is positioned along the user and the pliable skirt 172 forms a seal 195 around the periphery 173 of the mask 170. The strap 137 is connected to the strap buckles 178 located along the lateral side 177 of the frame 171 and extends around the user and through the outer housing 101. Extending along the upper front portion 106 of the outer housing 101 is the receiving passageway 128 with the end piece 186 of the snorkel 185 extending there through so that the end piece 186 is above the waterline 103.

Figure 11:
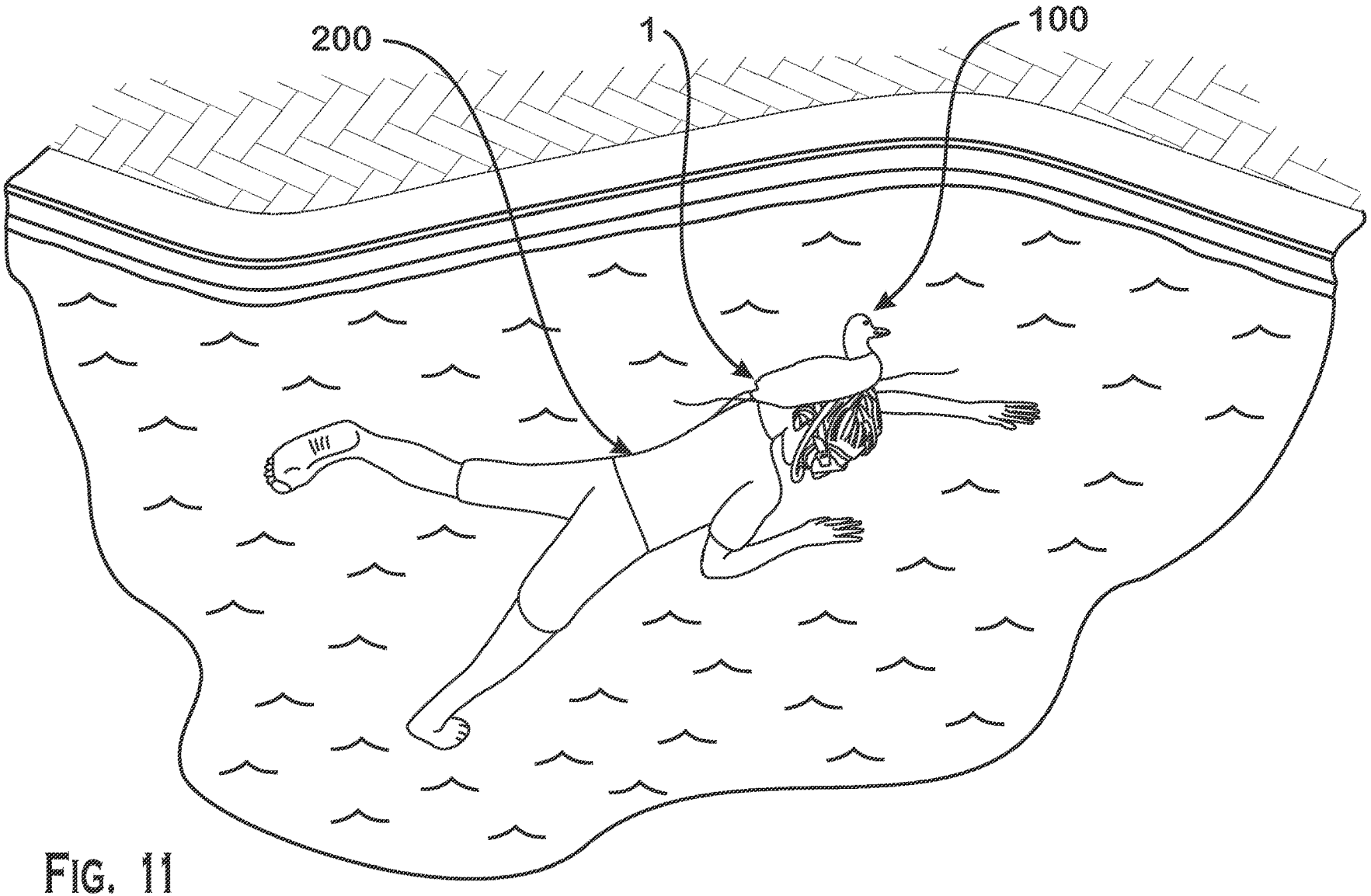
FIG. 11 is a perspective view of a floatable breathing device of the invention, shown in use.
Figure 12:
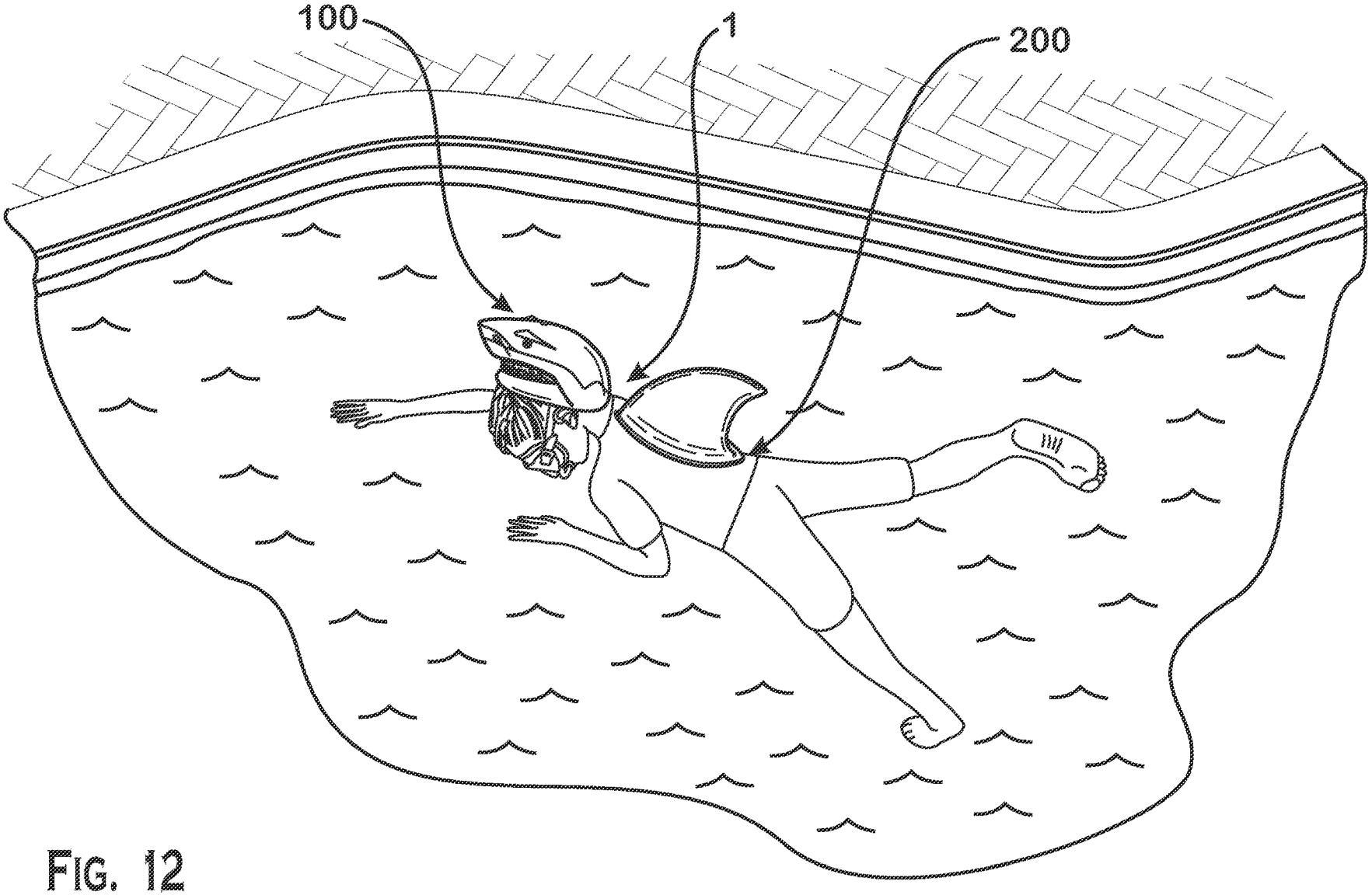
FIG. 12 is a perspective view of a floatable breathing device and an integrated swim shirt assembly according to the invention, shown in use

As shown in FIGS. 11 and 12, the head unit 100 is positioned along the user and with the end piece 186 of the snorkel 185 positioned above the waterline 103 and hidden. The swim shirt assembly 200 is positioned over the user's torso and head so that the user's arms are extended through the arm receiving sections 215 the head through the neck receiving section 217 and the upper body through the torso receiving section 218. In other embodiments there is no changeable insert peripheral 235 in the insert receiver 230. This could be the case where the swimmer is stronger and does not need added buoyancy along their torso but still needs the aid of the head unit 100 to keep the end piece 186 above the waterline 103. In this case the swim shirt assembly 200 is worn for coordination with the head unit 100 and or for sunscreen protection or rash guard protection.

The floatable breathing device 1 adds buoyancy to the user and permits the snorkel 185 from becoming immersed below the waterline 103. Further, seen is the integrated swim shirt assembly 200 without the changeable insert peripheral 235 and alternatively with the changeable insert peripheral 235 in the shape of a shark fin. In either case, with or without the changeable insert peripheral 235, the head unit 100 keeps the end piece 186 above the waterline 103.

One of ordinary skill in the art would recognize that the ornamental shape can be a variety of configurations and designs.

Figure 13:
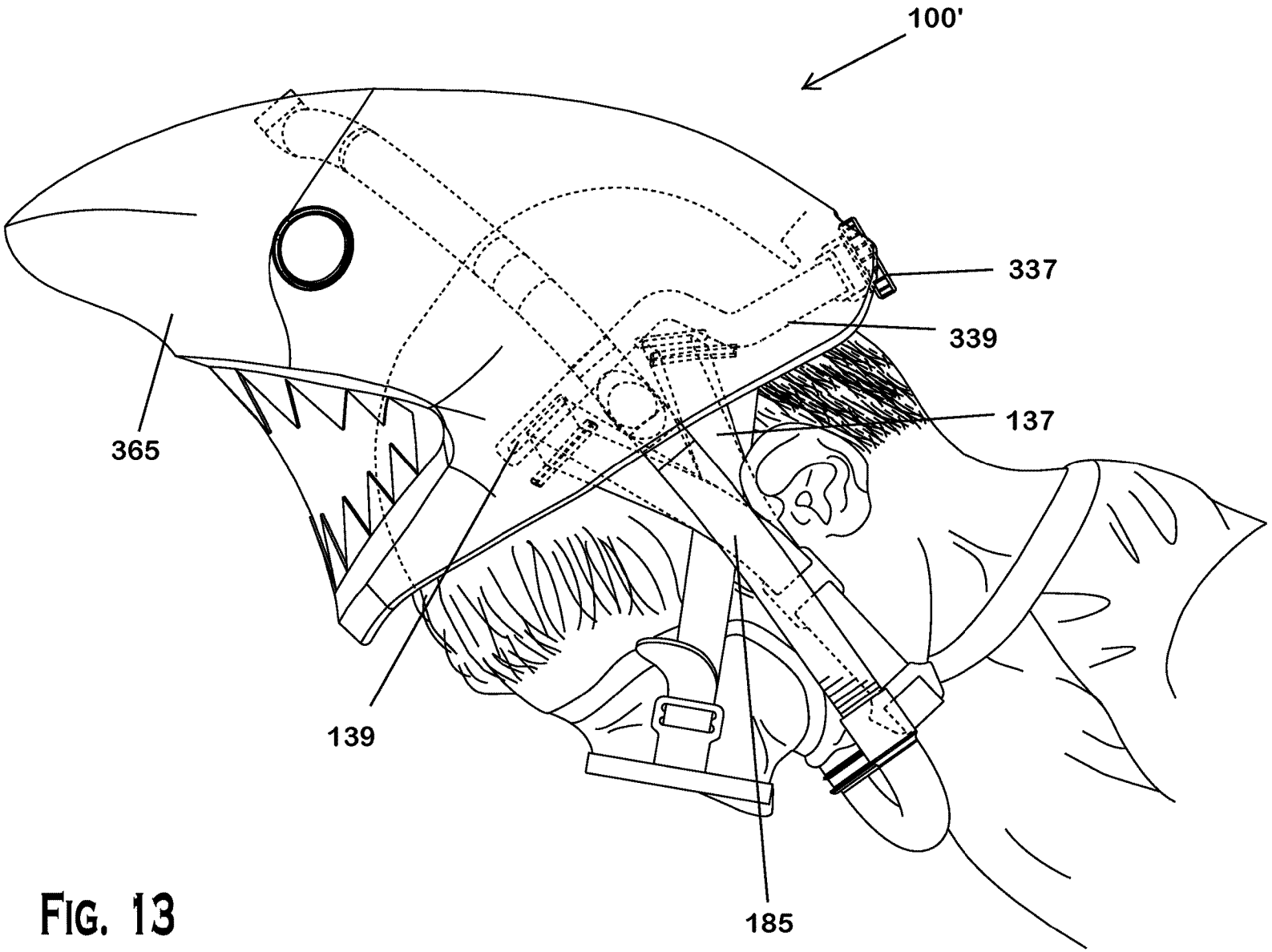
FIG. 13 is a side perspective view of an alternative floatable breathing device while in use, according to another embodiment of the invention.

Now with reference to FIGS. 13-21, an alternate embodiment of the head unit 100' will be described. For sake of brevity, only those elements that differ from the aforementioned embodiments will be described. As was noted previously, the head unit 100' can be interchangeable and can have a variety of different shapes. For example, the alternative head unit 100' depicted in FIG. 13 is shown as a representation of a shark head, though it is contemplated that alternative designs, such as an animal, or portion of an animal, or other recognizable character (e.g. media character), object, or other shapes may be represented, as will be understood by those of skill in the art. Without changing the functionality of the invention, alternative representations are possible, for example by providing a representation of another animal or a portion of the animal. As non-limiting examples, there may be provided a representation of a porpoise, penguin, hippopotamus, duck, or alligator, in place of the shark head as depicted. Alternatively, the head unit need not be limited to an animal, but rather may be provided as a representation of a recognizable creature or character. As non-limiting examples, there may be provided a head unit that is shaped as the neck and head portion of the Loch Ness Monster, or a depiction of a cartoon or movie creature, such as the Creature from the Black Lagoon. One skilled in the art should appreciate that other designs are possible and fall within the spirit of the invention.

Figure 16:
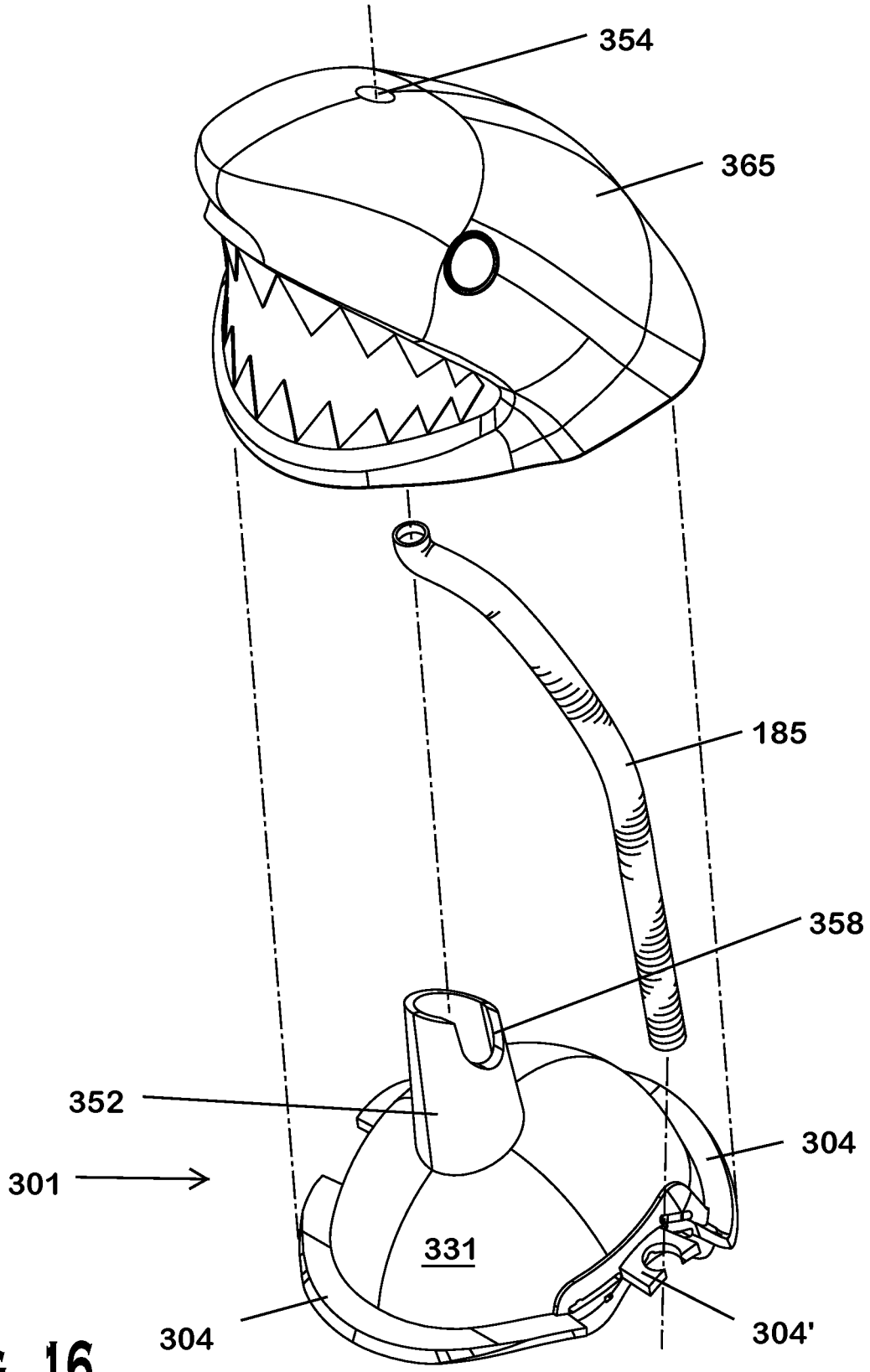
FIG. 16 is exploded view of the inner shell, outer buoyant material and portion of the snorkel tube of the floatable breathing device of FIG. 13.

The alternative head unit 100' of FIG. 13, and depicted in exploded view in FIG. 16, generally include the following major components: an inner shell 301, and a buoyant outer material 365, and a snorkel 185.

Figure 15:
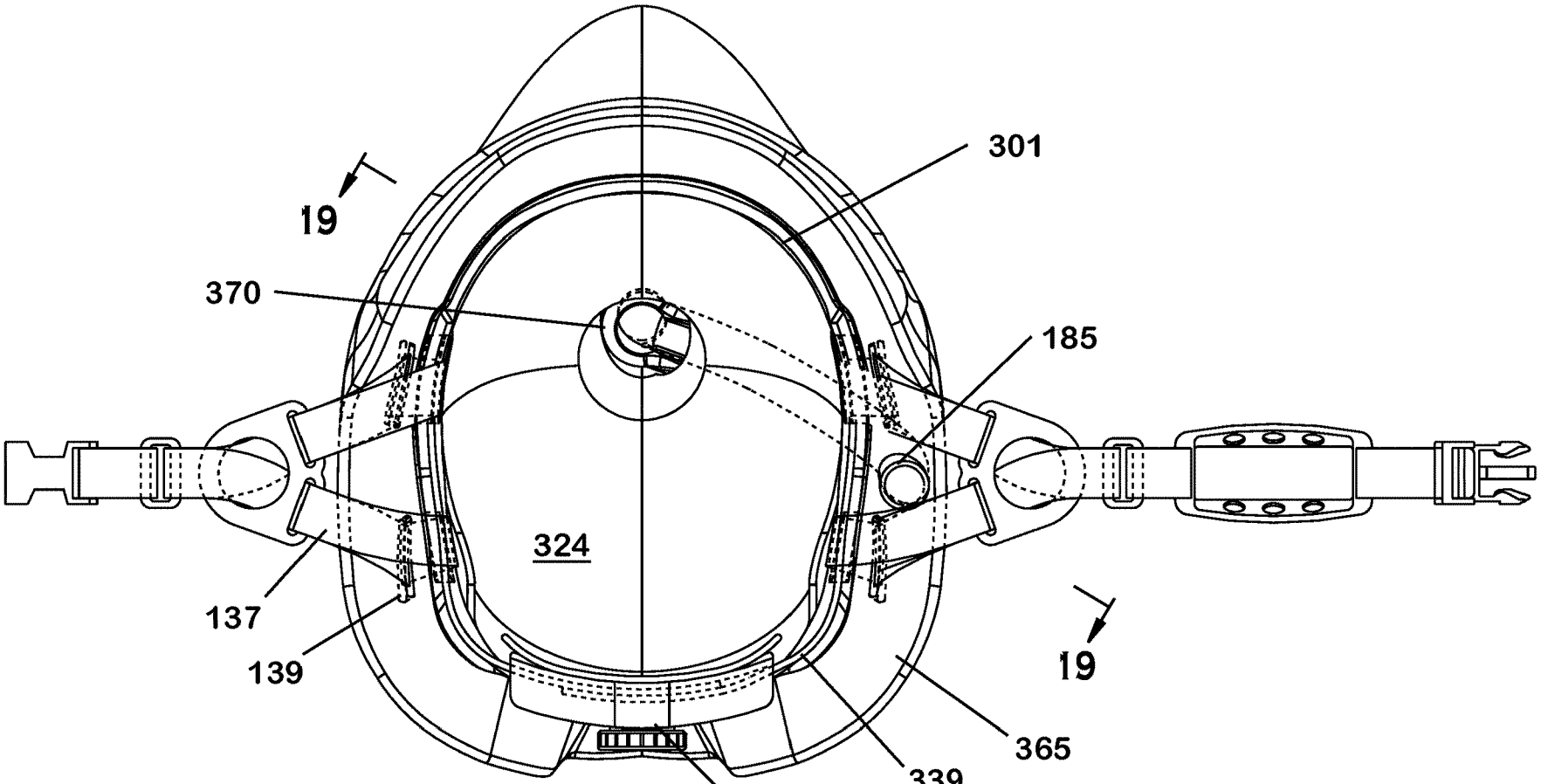
FIG. 15 is bottom perspective view of the floatable breathing device of FIG. 13, with the distal end of the snorkel removed for clarity.
Figure 18:
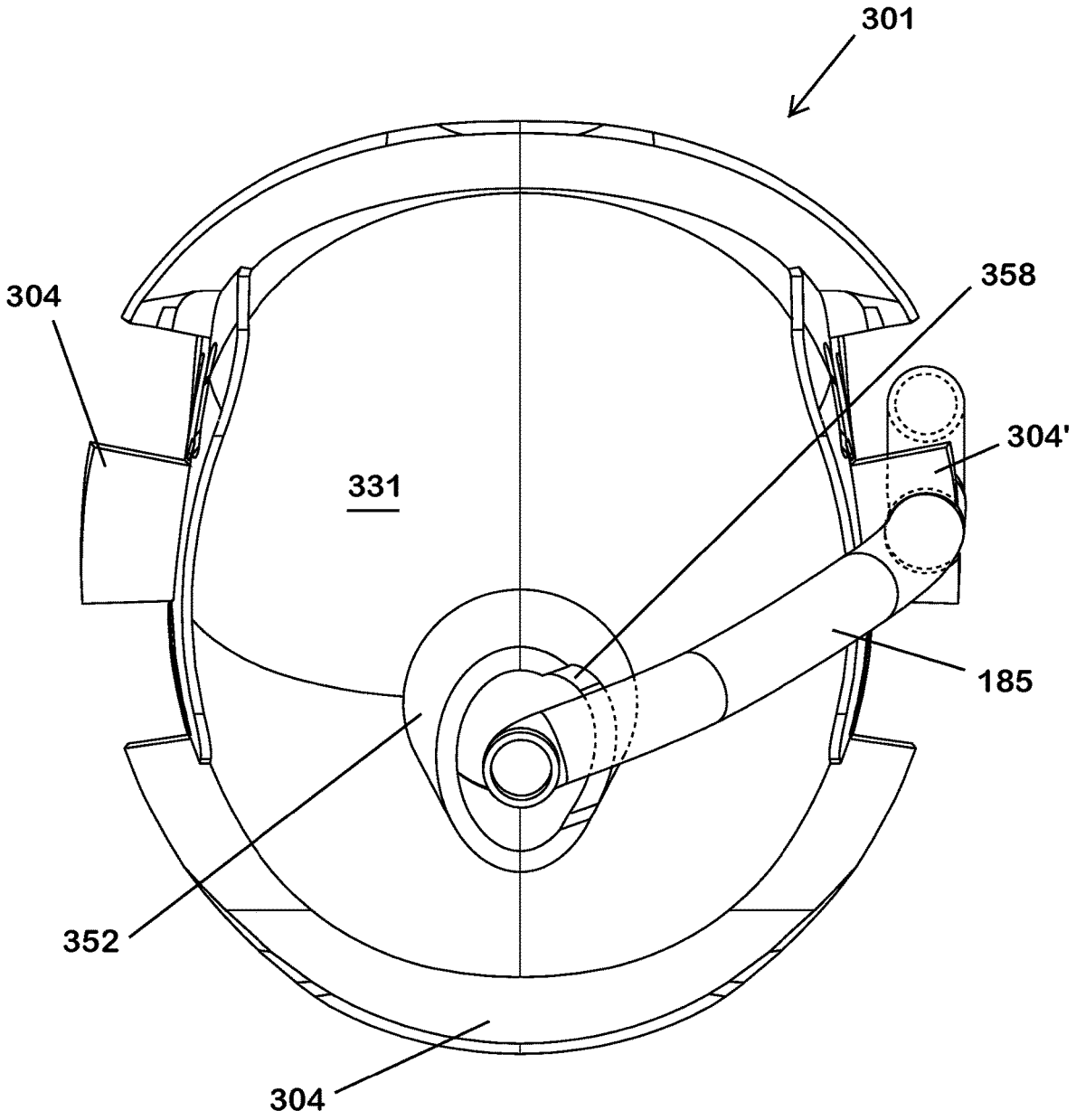
FIG. 18 is a top perspective view of the inner shell and a portion of the snorkel tube in isolation.

With reference to FIGS. 15, 16, and 18, the inner shell 301 is an interior shell of one or more of a foam, a polymer, a composite, a water resistant fabric. The inner shell 301, or at least portions of the inner shell 301, may be a rigid material. The inner shell may be impact resistant, and may be buoyant, or of neutral buoyancy, and having a density that is less than or equal to the density of 1 gm/cm$^3$. The inner shell 301 may be monolithically formed. The inner shell 301 has a head receiving section 150 that is generally dome shaped and has an inside surface 324 lining the cavity of the head receiving section. Opposite the inside surface, the inner shell 301 has an outside surface 331 that is facing towards the buoyant outer material 365.

The inner shell 301, specifically the head receiving section 150, is shaped to fit over a portion of a user's head, such as is depicted in FIG. 13. The inner shell 301 may be provided with one or more retaining straps 137, such as a chin strap as depicted, and/or an adjustable retention system 337, in order to retain the alternative head unit 100' in position while in use. The one or more retaining straps 137 may each be directed through one or more passageways 139, as will be discussed. The retentions system may provide a size adjustment mechanism, such that the inner shell 301 can fit a variety of user skull dimensions. In an embodiment, the retention system 337 provides a reversible ratcheting mechanism, such as a ratchet buckle, to adjust the size of the opening via the retention system. In another embodiment, as depicted in FIG. 15, the retention system utilizes a thumb wheel that operates a ratchet or rack and pinion gear mechanism to adjust the size dimension for the retention system. Such retention systems 337 are known for use with helmets (e.g. hard hats and bicycle helmets) and will be familiar to those of skill in the art. The retention system 337 is provided with a pair of opposing gripping arms 339 that are reversibly joined at one end in an adjustable manner by the size adjustment device, be it a ratcheting buckle, or thumbwheel, as shown. The other end of each of the opposing gripping arms is secured to the inner shell in a manner that is impervious to moisture, such as through the use of fasteners, or adhesives. The retention system 337 is configured to have the opposing gripping arms 339 partially encircle the back of the user's head, and size adjusted to secure the head unit 100' to the user's head, as depicted in FIG. 13.

The inner shell 301 may optionally be lined with a comfort or fit enhancing material to rest against the user's head while in use. Alternatively, one or more resiliently compressible pads may optionally be provided and removably attached to the inner surface 324 of the inner shell 301, to enhance comfort and customize the fit of the inner shell 301 against the user's head. Such removable pads are commonly utilized with bicycling helmets, and may be affixed, for example with a hook and loop application to the respective surfaces to be joined.

Figure 19:
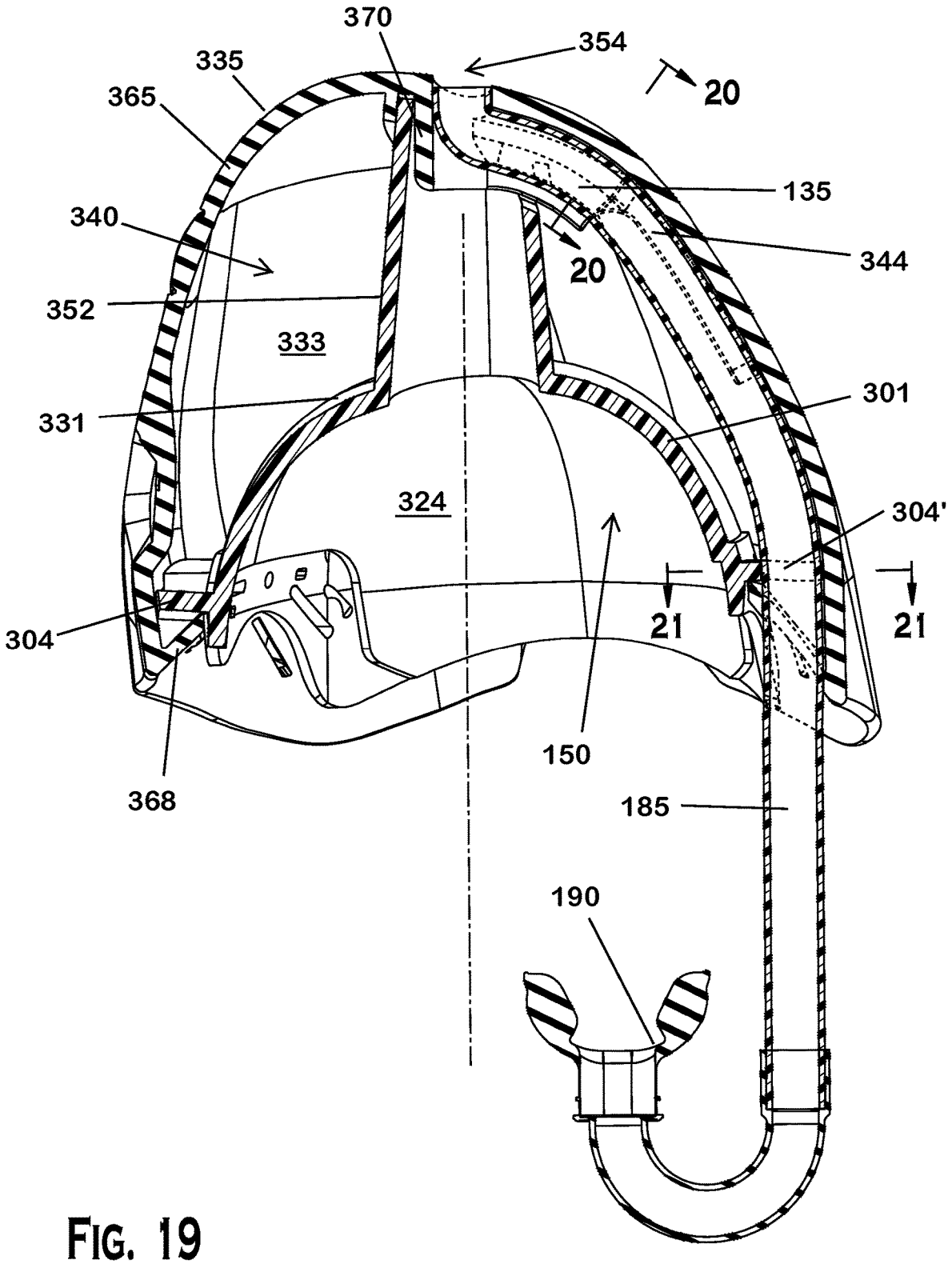
FIG. 19 is a cross-section view of the floatable breathing device of FIG. 15, taken along line 19-19.
Figure 20:
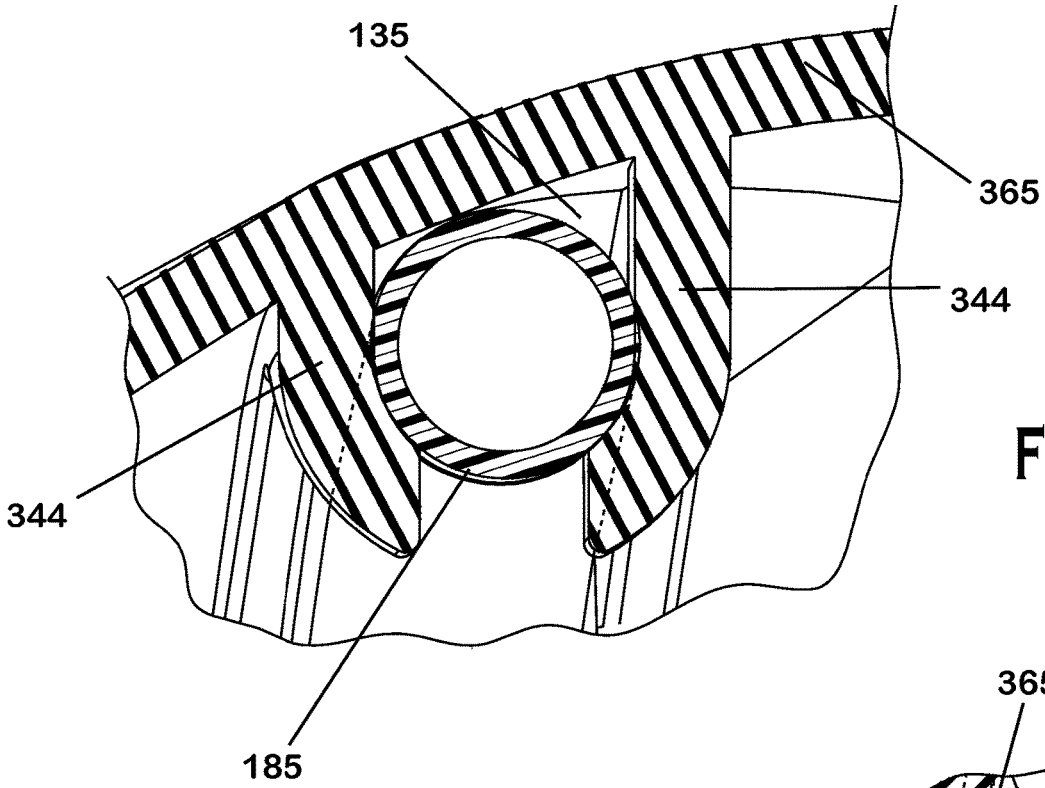
FIG. 20 is an expanded cross-section view of a portion of the buoyant outer material and snorkel tube of the floatable breathing device of FIG. 19, taken along line 20-20.
Figure 21:
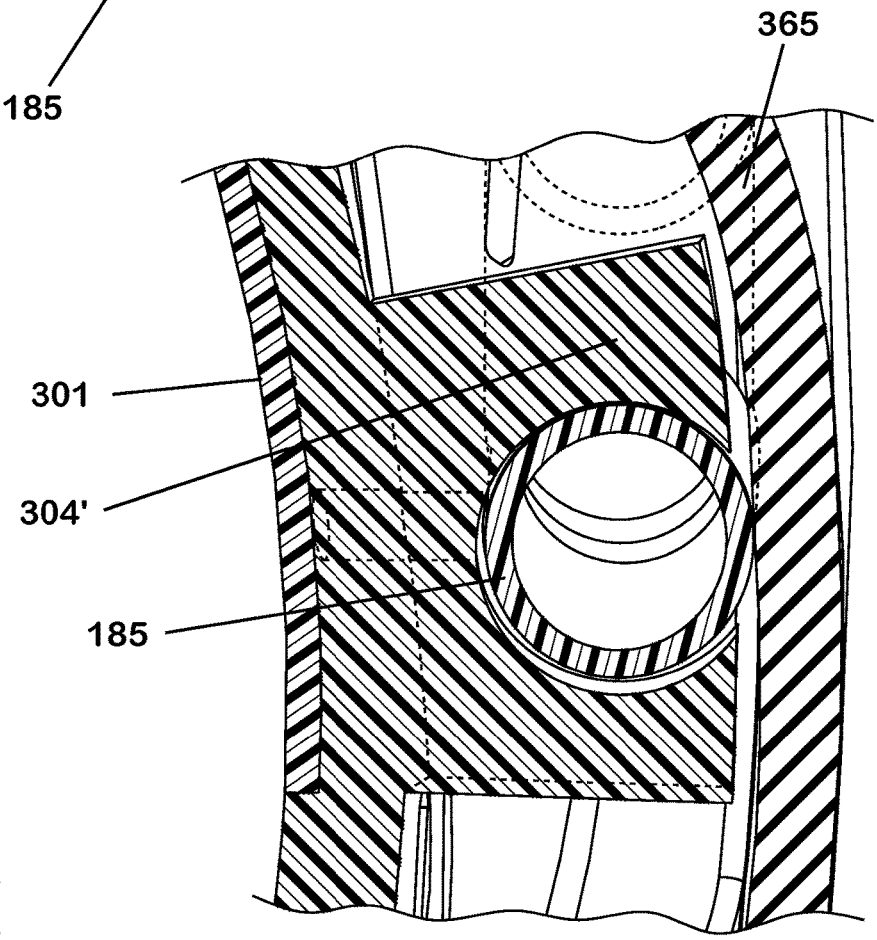
FIG. 21 is an expanded cross-section view of a portion of the buoyant outer material, inner shell, and snorkel tube of the floatable breathing device of FIG. 19, taken along line 21-21.

The inner shell 301 may have one or more protruding flanges 304 on the outside surface 331 of the inner shell 301, such that the protruding flanges 304 can engage with the inside surface 333, or features of the buoyant outer material 365. Details of the protruding flange portions will be discussed below. The inner shell 301, as can be seen with reference to FIGS. 15 and 16, and in cross-section view of FIG. 19, is provided with a protruding vent portion 352 that extends up from the head receiving portion 150 of the inner shell 301, towards the top of the alternative head unit 100', and can accommodate the passage of a snorkel 185, through at least a portion of the vent portion 352, as will be discussed.

With reference to FIGS. 13, 14, 16, and 17, the buoyant outer material 365 is a molded material formed in the desired shape of the animal, character or creature being represented. The buoyant outer material may be a light density material, such a foam serves to add buoyancy to the alternative head unit 100'. In an exemplary embodiment, the buoyant outer material is a durable, water impenetrable foam. The foam of the buoyant outer material may be a soft, closed cell foam. In an exemplary embodiment, the buoyant outer material may have a coating on one or both of the exterior surface 335 and interior surface 333 of the buoyant outer material 365, such as a polymer coating, for example, a vinyl coating. In any of the embodiments, the buoyant outer material 365 may be provided with an exterior surface that provides appropriate coloration and or texture for the character or object being depicted. In an embodiment having a polymer coating, the coating on the exterior surface of the buoyant outer material may provide desirable surface texture and coloration, in addition to providing water impermeability, toughness, and resistance to fouling, such as mildew growth in the buoyant outer material. In an embodiment, the buoyant outer material 365 is painted or molded to provide appropriate color pattern on the exterior and visible surfaces.

The buoyant outer material 365 may be of an average density less than 1 gm/cm3. In an exemplary embodiment, the buoyant outer material may be a formed shape construction having a bladder filled with a gas that adds buoyancy to the shape. In an embodiment, the buoyant outer material 365 is a water and UV resistant closed cell foam, similar to that known for use in pool floats and pool noodles. In an exemplary embodiment, the buoyant outer material 365 is a closed cell, injection molded polymer foam. The closed cell foam for the buoyant outer material may be of any suitable polymer, including ethylene-vinyl acetate foam, polyethylene foam, or foam rubber, or other suitable polymer as will be familiar to those of skill in the art. The polymer for the foam may optionally be cross-linked. The buoyant outer material may be soft and resilient.

Figure 14:
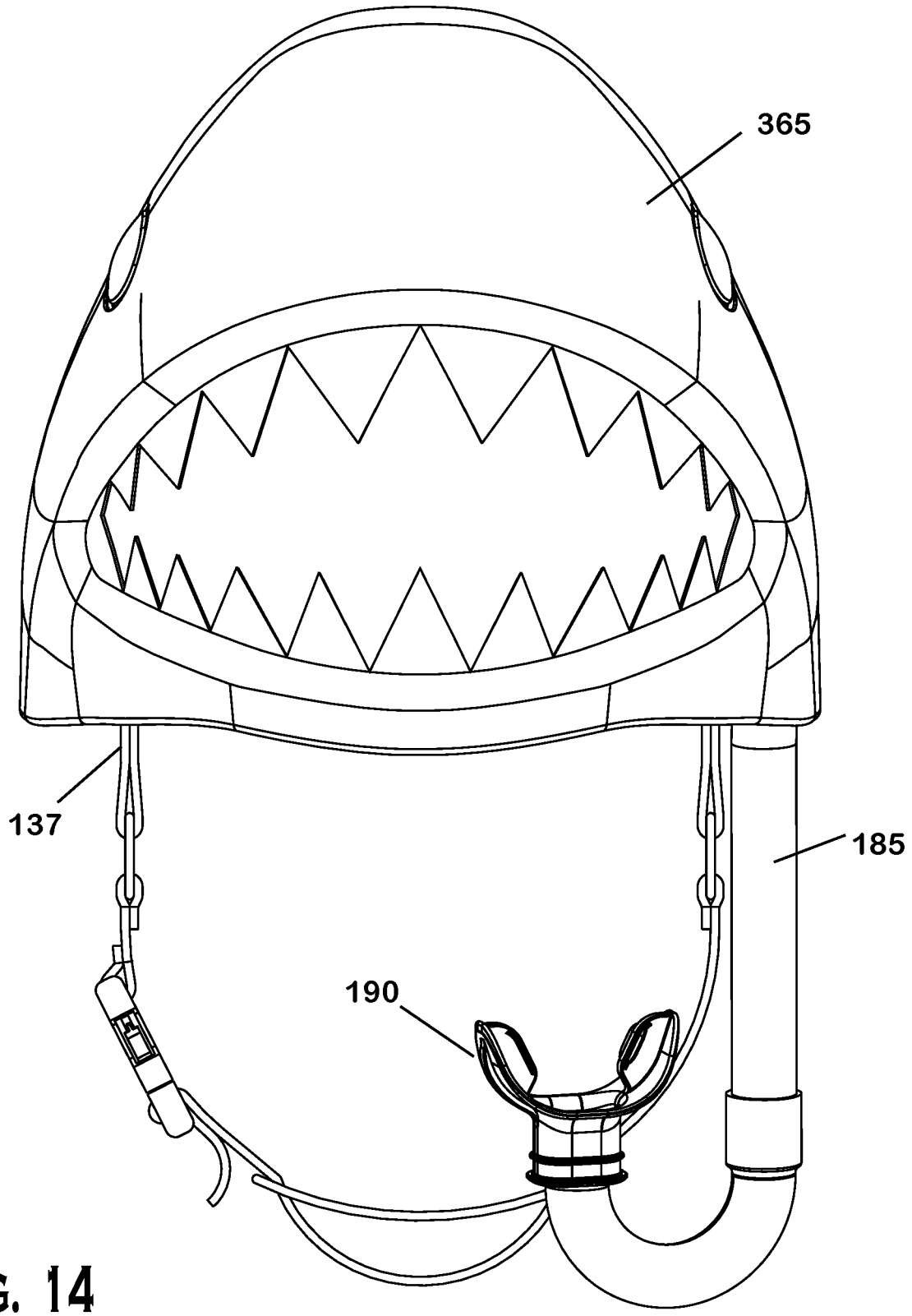
FIG. 14 is a front perspective view of the floatable breathing device of FIG. 13.

The buoyant outer material 365 may be molded, or otherwise shaped to have an external profile appropriate for the item, animal, or character being represented, for example, the shark head as depicted in FIGS. 13 and 14. An interior portion 333 of the buoyant outer material 365 may also be molded or otherwise shaped to accept within the interior aspect the inner shell 301. Thus, the buoyant outer material 365 may be understood to be a modified bell shape, with the exterior aspect, (e.g. the exterior surface 335) providing the shape of the object being represented; and further having an internal cavity that can fit over and accept within the internal cavity the inner shell 301, as depicted in cross-section in FIG. 19. The inner shell 301 may be secured to the buoyant outer material 365 in any suitable fashion, such as by using one or more of fasteners, adhesives, interlocking components, or friction fit. With the inner shell 301, and buoyant outer material 365 assembled together, there may, in some embodiments, remain a hollow 340 within the alternative head unit 100', above the inner shell 301 and contained within the interior of the buoyant outer material 365. Alternatively, the buoyant outer material 365 may be shaped to generally conform against the inner shell exterior surface, with little to no gap. The alternative head unit 100' may be provided with a vent opening 354 positioned generally near the top of the buoyant outer housing 365 when in a position as worn by the user while in use in a typical surface snorkeling position, as depicted in FIG. 13. The vent opening is dimensioned to accommodate the tube or end piece 186 at the proximal end of the snorkel 185, and also allow for venting of the interior of the head unit 100'. Thus the vent opening 354 is of a dimension, such as area, that is greater than the dimension of the end piece 186 of the snorkel tube 185. The vent opening 354 is a hole formed through the thickness of the buoyant outer material 365 and would allow the passage of fluid (such as air) therethrough, thereby allowing equalization of pressure inside the hollow 340 of the alternative head unit 100' when it is being at least partially submerged, or when the user is raising at least a portion of the head unit 100' out of the water, such as when the user would return to the surface or exit out of the water, thereby allowing water to readily escape through gaps between the base of the head unit 100' and the user's head, as air passes through the vent opening. Optionally, it is contemplated that one or more water passages may further be provided at or near the bottom of the alternative head unit 100' to facilitate ingress and egress of water into and from the interior of the head unit 100'.

As shown in FIG. 15, the inner shell 301 and buoyant outer material 365, when assembled together, will have passageways 139 that are generally aligned, so as to allow the one or more retaining straps 137 each to be routed in a loop through the respective passageways 139 for each of the inner shell 301 and the buoyant outer material 365. Each retaining strap 137 as it is directed through the respective passageways of the inner shell 301 and the buoyant outer material 365, thus may also help retain the two components together, in addition to providing a means of securing the alternative head unit 100' to the head of the user. In the exemplary embodiment depicted in FIG. 15, the retaining straps 137 are each looped through a pair of passage ways 139, and continue away from the inner shell 301 and buoyant outer material 365 to form a chin strap that can be secured with a releasable mechanism, such as a buckle, as will be familiar to those of skill in the art, and for example, as shown in FIGS. 13 and 15. Optionally, the strap 137 may also pass through a passageway in the arm 339 of the retention system 337, as depicted in FIG. 13.

With reference to FIG. 16, there is shown in the exploded view a perspective view of the inner shell 301, separated from the outer buoyant material 365 of the alternative head unit 100'. The inner shell 301 has a head receiving portion 150 that is configured to receive part of a user's head therein, and further provides a protruding portion 352 that extends upwards from the head receiving portion, and serves as a conduit for fluid, such as air, to pass through between the head receiving portion 150, and the vent opening 354 at the top of the alternative head unit 100'. As depicted, the protruding portion 352 may have a cutout 358, for accommodating the passage of a tube for the snorkel 185 from outside the inner shell 301 into the interior of the protruding portion 352, such that the snorkel can further pass within the fluid conduit towards the vent opening 354. As depicted in FIG. 16, the cutout 358 is located at the top of the protruding portion 352, through it is recognized that the cutout 358 may be an opening in the side of the protruding portion 352, and not necessarily located at the top of the protruding portion as shown. The inner shell 301 further has at least one laterally directed flange 304', having an opening for receiving a portion of the tube of the snorkel 185. The opening in the laterally directed flange 304' would be in alignment with a corresponding snorkel entry opening 360 created in the buoyant outer material 365, to accommodate the passage of the snorkel tube therethrough, as can be seen with reference to FIGS. 15 and 17. Additionally, one or more flanges 304 may extend out from the outer surface 331 of the inner shell 301. Each of the flanges 304 may engage with the interior surface 333 of the buoyant outer material 365, and serve to secure the inner shell 301 within the dimensions of the buoyant outer material 365. The flanges 304 may be interrupted underneath the passageways 139, in one or more locations, in order to allow passage of the retaining straps 137. In an embodiment, the buoyant outer material 365 is provided with an inwardly protruding lip 368 at or near the bottom of the buoyant outer material 365, as shown in FIG. 19. The inner shell 301 may be secured to the buoyant outer material 365 in any suitable manner. In an embodiment, the inner shell 301 is secured to the buoyant outer material 365 by causing the lip 368 near the bottom of the buoyant outer material to be resiliently extended over the flange(s) 304 of the inner shell, such that the flange(s) will reside against the top of the lip 368, thereby securing the inner shell 301 within the dimensions of the buoyant outer material 365. The inner shell 301 and outer buoyant material 365 may also be retained together by the nature of the looped straps 137 that are directed through respective passageways 139 of the components, and optionally through a passageway 139 in arm 339 of the retention system 337. If so desired, an adhesive or fastener may optionally be applied to further secure the inner shell 301 and the buoyant outer material 365 together.

Figure 17:
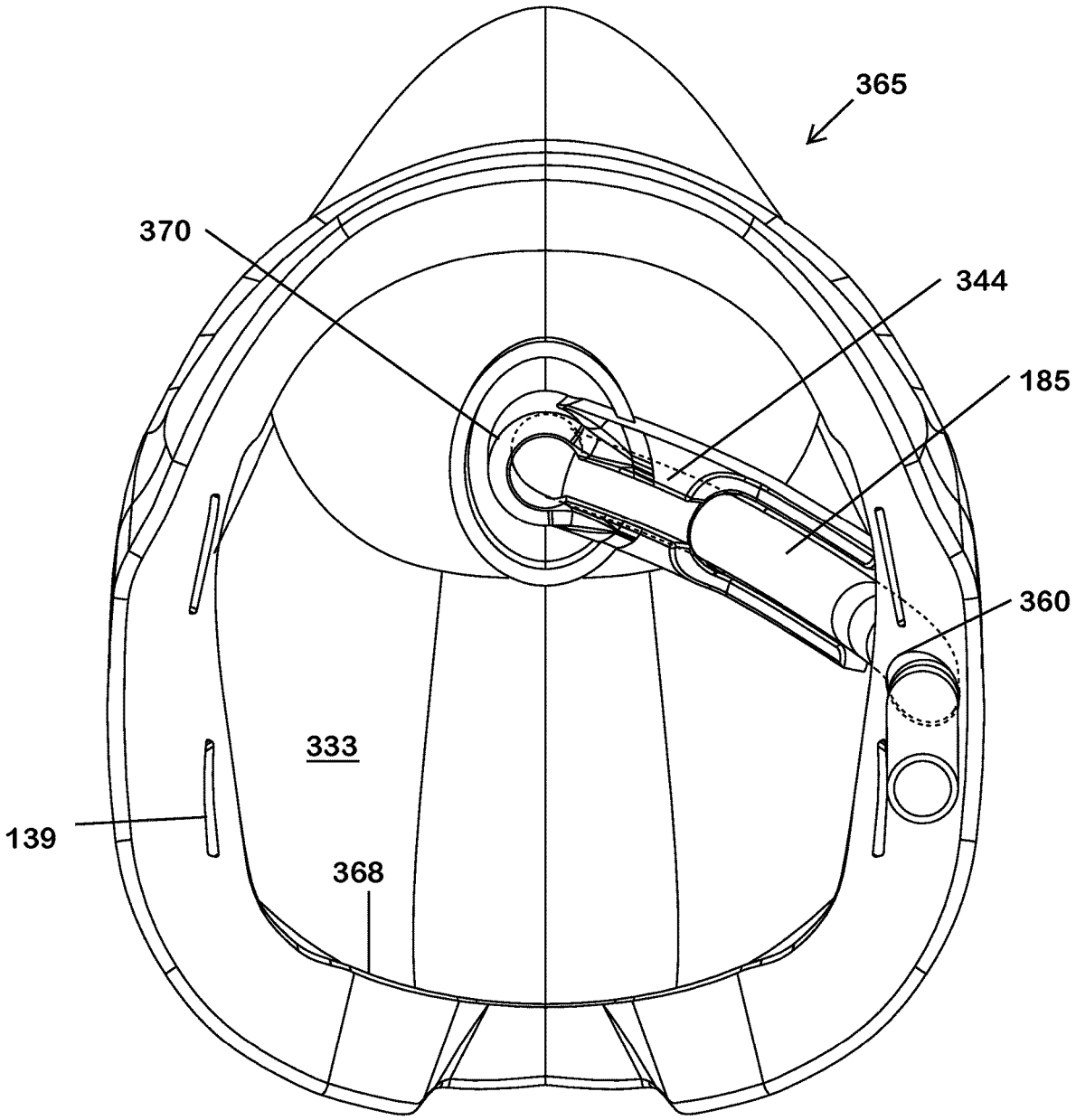
FIG. 17 is a bottom perspective view showing the internal aspects of the buoyant outer material and a portion of the snorkel tube in isolation.

The assembled head unit 100', having the inner shell 301 secured within the buoyant outer material 365 together will provide an internal passageway 135 that serves as a channel or routing through which a snorkel tube 185 is to be directed. As can be seen with reference to FIGS. 13 and 14, the snorkel tube 185 is to be positioned with the mouthpiece 190 at the distal end of the snorkel tube 185 in place below the head unit 100', in a position that will be accessible to the user's mouth when the head unit 100' is worn. The snorkel tube 185 adjacent to the mouthpiece is to be bent in a U-shape, such that the snorkel tube 185 can be directed up through a receiving passageway 128, depicted as the snorkel entry opening 360 in the bottom edge of the buoyant outer material 365 in FIG. 15, then passing through the flange 304' with the cutout configured to accommodate the snorkel tube 185 therethrough, and continue upwards through the internal passageway 135, passing through the cutout 358 in the protruding vent portion 352 of the inner shell 301, and into or resting against the vent opening 354 provided in the buoyant outer material 365. At least a portion of the snorkel tube 185 may be bendable, in order to be directed through the internal passageway 135 towards the vent opening 354 at or near the top of the head unit 100'. As depicted in FIG. 17, the inside surface 333 of the buoyant outer material 365 may be provided with a pair of ridges 344 that define portions of the internal passageway 135, where the ridges 344 together form sidewalls of the internal passage 135 to accept the snorkel tube 185 therein, at least in the portion of the internal passageway 135 where the buoyant outer material 365 is adjacent to the inner shell 301. As the snorkel tube 185 passes further along the internal passageway 135, and entered into the hollow 340, if present, the ridges 344 may become more pronounced, as depicted in FIGS. 17 and 19 and in enlarged cross-section view in FIG. 20, and are optionally curved inwards towards each other, partially encircling the snorkel tube 185, with only a small gap that is smaller than the diameter of the snorkel tube 185 remaining between the ridge ends, such that the gap remaining between the ends of the ridges 344 is of a size that will prevent the displacement of the snorkel tube outside of the internal passageway through the gap. The snorkel tube 185 is then directed through the cutout 358 provided in the protruding vent portion 352 of the inner shell 301, and continues upwards towards the vent opening 354 at or near the top of the buoyant outer material 365. To aid in the directing of the snorkel tube 185 to transition to a near vertical orientation within the protruding vent portion 352, the buoyant outer material 365 on the interior surface 333 may be provided with a deflecting wall 370 that is to reside inside the protruding portion of the inner shell 301 when the inner shell 301 and outer buoyant material 365 components are assembled together. In an embodiment, the deflecting wall 370 is a continuation of the ridges 344 portions as the internal passage 135 transitions to generally vertical, such that the snorkel tube 185 as it is advanced up the internal passage is caused to bend and be redirected towards the vent opening 354. The proximal end of the snorkel tube 185, such as the end piece 186, when properly positioned near the top of the head unit 100' does not completely occlude the vent opening 354, but rather fits inside, through, or adjacent to the vent opening 354, while still allowing the passage of fluid, such as air, through the vent opening, but outside of the snorkel tube 185, in order to allow equalization of pressure within the interior of the head unit 100', thereby allowing water to enter and exit from both the space between the inner shell 301 and the buoyant outer material 365, as well as the interior aspect of the head receiving portion 150 of the inner shell 301, as the head unit 100' is submerged into and raised out from the water.

The foregoing illustrates some of the possibilities for practicing the invention. Many other embodiments and fields of use for the floatable breathing device 1 are possible and within the scope and spirit of the invention. It is, therefore, intended that the foregoing description be regarded as illustrative rather than limiting.

What is claimed is:

1. A floatable breathing device, comprising a head unit with buoyant properties and having an ornamental shaped buoyant outer material and an inner shell positioned within the buoyant outer material, the inner shell forms a head receiving section and a protruding section, the head receiving section is received internal to the buoyant outer material and is configured to be contoured to a human head, the protruding section extending from the head receiving section to a vent opening in the buoyant outer material;

a snorkel connected to and extending through the head unit;

a plurality of receiving passageways disposed about the inner shell and receiving the snorkel, the snorkel extending through and exiting a portion of the head unit at the vent opening; and an internal pathway positioned along a base of the buoyant outer material and extending between the internal shell and the buoyant outer material, wherein the internal pathway passes through an interior of the interior shell through a cutout in a protruding portion thereof and terminating adjacent to the vent opening.

2. The floatable breathing device of claim 1, wherein the buoyant outer material is an exterior foam shape and the inner shell is an interior shell configured to receive a human head.

3. The floatable breathing device of claim 2, wherein the inner shell further provides a retention system having a size adjustment mechanism.

4. The floatable breathing device of claim 3, wherein the size adjustment mechanism has a pair of opposing gripping arms that are reversibly joined in an adjustable manner.

5. The floatable breathing device of claim 3, wherein the size adjustment mechanism is one of a ratchet mechanism or gear mechanism.

6. The floatable breathing device of claim 1, wherein the snorkel includes an end piece positioned at a proximal end thereof and a mouthpiece positioned at a distal end thereof.

7. The floatable breathing device of claim 6, wherein snorkel further includes a barrel section positioned below the end piece and having a bendable section.

8. The floatable breathing device of claim 7, wherein the bendable section is positioned through the internal pathway.

9. The floatable breathing device of claim 1, wherein the buoyant outer material is shaped as an animal.

10. The floatable breathing device of claim 1, further comprising at least one strap receiving passageway formed in each of the buoyant outer material and inner shell that are aligned relative to each other to thread a strap through the head unit.

11. The floatable breathing device of claim 1, wherein the internal pathway and the protruding section are directed through a hollow in the interior of the buoyant outer material.

12. The floatable breathing device of claim 1, wherein the buoyant outer material further has a lip, and the inner shell further has at least one flange protruding laterally out from the head receiving section.

13. The floatable breathing device of claim 12, wherein the buoyant outer material is secured to the inner shell by passing the lip of the buoyant outer material past the at least one flange of the inner shell as the inner shell is inserted into the buoyant outer material, thereby retaining said buoyant outer material and inner shell together.

14. The floatable breathing device of claim 1, wherein the vent and the protruding section allow the interior of the buoyant outer material to equalize pressure as the floatable breathing device is moved vertically relative to a water level.

* * * * *